US010946501B2

(12) United States Patent
Patil et al.

(10) Patent No.: US 10,946,501 B2
(45) Date of Patent: Mar. 16, 2021

(54) TOOL SYSTEM

(71) Applicant: Ridge Tool Company, Elyria, OH (US)

(72) Inventors: Prasad Chatursingh Patil, Pune (IN); Sachin Shashikant Dakare, Katraj (IN); Krishnarjun Bhagwan Chhatre, Pune (IN); Sandeep Sidagouda Patil, Pune (IN); Glen R. Chartier, Avon Lake, OH (US); Lawrence Feskanich, Jr., Olmsted Township, OH (US)

(73) Assignee: Ridge Tool Company, Elyria, OH (US)

( * ) Notice: Subject to any disclaimer, the term of this patent is extended or adjusted under 35 U.S.C. 154(b) by 174 days.

(21) Appl. No.: 15/446,600

(22) Filed: Mar. 1, 2017

(65) Prior Publication Data

US 2018/0056489 A1 Mar. 1, 2018

(30) Foreign Application Priority Data

Aug. 24, 2016 (IN) ..... 201621028896

(51) Int. Cl.

| | |
|---|---|
| ***B25B 13/48*** | (2006.01) |
| ***B25B 13/50*** | (2006.01) |
| ***B25B 23/00*** | (2006.01) |
| ***B25F 1/04*** | (2006.01) |
| ***B25G 1/06*** | (2006.01) |

(52) U.S. Cl.

CPC ..... *B25B 13/481* (2013.01); *B25B 13/5091* (2013.01); *B25B 23/0028* (2013.01); *B25B 23/0035* (2013.01); *B25F 1/04* (2013.01); *B25G 1/066* (2013.01)

(58) Field of Classification Search

CPC ... B25G 1/066; B25B 13/481; B25B 13/5091; B25B 23/0028; B25B 23/0035; B25F 1/04

USPC ..... 81/124.4

See application file for complete search history.

(56) References Cited

U.S. PATENT DOCUMENTS

| | | | | | |
|---|---|---|---|---|---|
| 65,550 | A * | 6/1867 | Dunlap | B25B 13/005 | 81/124.5 |
| 183,736 | A * | 10/1876 | Wilson | B25B 13/463 | 81/63 |
| 608,866 | A * | 8/1898 | Jones | B25B 13/463 | 81/62 |
| 5,005,451 | A * | 4/1991 | Lee | B25B 9/00 | 269/16 |
| 5,048,378 | A * | 9/1991 | Nikolas | B25B 13/06 | 81/124.2 |
| 5,996,447 | A * | 12/1999 | Bayouth | B25B 13/06 | 81/121.1 |

(Continued)

FOREIGN PATENT DOCUMENTS

CN 101583465 11/2009

OTHER PUBLICATIONS

CN Office Action dated Dec. 3, 2018; Application 201710228603.0; 10 Pages.

*Primary Examiner* — Hadi Shakeri

(74) *Attorney, Agent, or Firm* — Mark E. Bandy; Rankin, Hill & Clark LLP

(57) ABSTRACT

A multi-purpose hand tool system is described. The tool system includes a handle and one or more inserts that are releasably engaged with the handle. The tool system is useful for a variety of applications including use with basin and faucet hardware.

2 Claims, 30 Drawing Sheets

(56) References Cited

U.S. PATENT DOCUMENTS

| | | | | |
|---|---|---|---|---|
| 6,286,396 | B1 * | 9/2001 | Johnson | B25B 9/00 81/177.2 |
| 6,314,841 | B1 * | 11/2001 | Burk | B25B 13/06 81/124.2 |
| 6,701,807 | B1 | 3/2004 | Gammon | |
| D560,986 | S | 2/2008 | Adkins et al. | |
| 7,340,984 | B2 * | 3/2008 | Hsieh | B25B 13/06 81/125.1 |
| 8,347,762 | B2 * | 1/2013 | Jones | B25B 13/5091 81/121.1 |
| 8,459,151 | B2 * | 6/2013 | Wang | B25B 13/107 81/124.3 |
| 9,114,509 | B2 * | 8/2015 | Lovely | B25B 13/463 |
| 9,156,141 | B2 * | 10/2015 | Chang | B25B 13/56 |
| 2004/0255727 | A1 * | 12/2004 | Kovach | B25B 13/02 81/176.15 |
| 2008/0034927 | A1 | 2/2008 | Adkins et al. | |
| 2011/0290084 | A1 | 12/2011 | Wang et al. | |

* cited by examiner

TOOL SYSTEM

FIELD

The present subject matter relates to a multipurpose tool system. The tool system is generally directed to hand tools and particularly for hand tools such as basin and faucet wrenches.

BACKGROUND

Basin wrenches or special purpose installation tools are used to secure a variety of kitchen or bathroom faucets, hoses, spray hoses, and/or related components. Faucet installation hardware is typically located at confined areas below a kitchen or bathroom sink. Thus, such hardware is difficult to access with a conventional regular wrench or spanner.

A wide variety of installation hardware is used in this field such as plastic wing nuts, hex nuts of different sizes, Phillipps screws and flat screws. In addition, the types of installation hardware and methods of installation may vary between different faucet manufacturers.

In order to be useful, a basin or faucet wrench should be relatively compact so that the wrench can be used in tight spaces and provide flexibility to fit around obstructions typically located under a sink or basin such as supply lines and drains.

Currently known basin and faucet wrenches include those that utilize a handle and one or more inserts to accommodate different installation hardware, such as described in US 2008/0034927 and D560,986, both of which are assigned to Applicant.

Another known tool is described in U.S. Pat. No. 6,701,807. The '807 patent describes a socket device with an off-center slot for loosening or tightening connectors.

Although the noted tools are satisfactory in certain regards, a need remains for an improved tool system and one that is particularly adapted for use with basin or faucet hardware.

SUMMARY

The difficulties and drawbacks associated with previous approaches are addressed in the present subject matter as follows.

In one aspect, the present subject matter provides a basin wrench comprising a handle defining a generally hollow interior. The handle also defines at least one end configured to receive an insert and a longitudinal slot extending from the at least one end of the handle and providing access to the hollow interior of the handle. The wrench also comprises a multiface insert configured for selective positioning relative to the end of the handle. The insert defines (i) a first face having a first engagement region sized and shaped to fittingly engage a first faucet component, and (ii) a second face having a second engagement region sized and shaped to fittingly engage a second faucet component different from the first faucet component. The insert can be selectively positioned with the end of the handle such that either the first face or the second face of the insert is accessible for engagement with the first or second faucet component.

In another aspect, the present subject matter provides a basin wrench comprising a handle defining a generally hollow interior, and at least one end configured to receive a removable cube-shaped insert. The basin wrench also comprises a cube-shaped insert removable from and selectively engageable with the end of the handle. The insert defines a plurality of working faces, each working face defining an engagement region sized and shaped to fittingly engage a faucet component.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

The present subject matter tool system is useful for engaging, e.g., loosening or tightening, a variety of fixtures and hardware and particularly for rotating basin nuts, for example, basin nuts to attach a faucet unit to a countertop. The tool system is also useful in many other applications for example tightening ⅞ inch supply line nuts, plastic wing supply nuts, 1 inch supply line nuts (and nuts having other, for example metric, dimensions) and supply line shut off valves. Accordingly, the present subject matter should not be limited to only a wrench for loosening basin nuts, but instead should be construed broadly.

Figure 1:
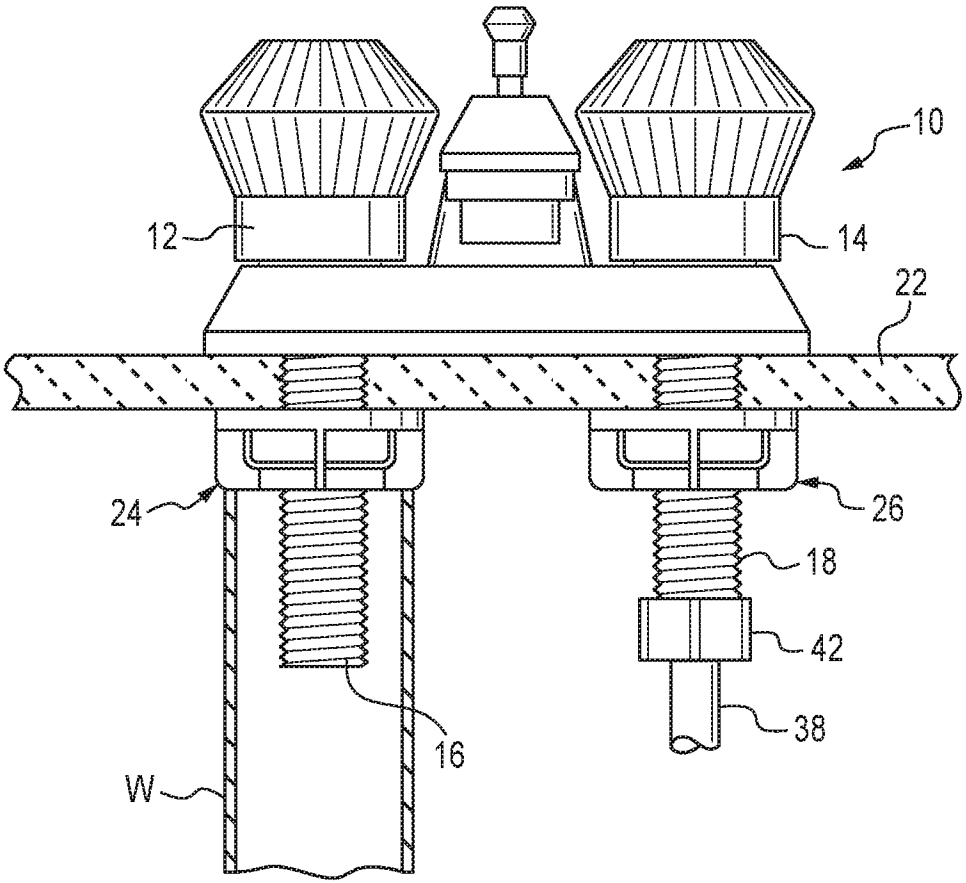
FIG. 1 (PRIOR ART)
FIG. 1 is an elevational partial cross-sectional view of a typical vanity faucet assembly depicting one of the basin nuts of the faucet being engaged by a known basin wrench (only a portion of which is shown in FIG. 1).

FIG. 1 schematically depicts a typical vanity faucet assembly 10 affixed to a countertop 22. The faucet assembly 10 includes faucets or controls 12, 14 which typically control flow of hot and cold water through supply lines such as supply line 38. The faucet assembly 10 also includes threaded members 16, 18 which extend through the countertop. Basin nuts 24, 26 engage the threaded members 16, 18. As is known, conventional wrenches or sockets W are used to engage a basin nut such as 24 in FIG. 1 in order to loosen or tighten the basin nut 24 along the threaded member 16. Similarly, conventional wrenches or sockets (not shown) are used to engage a fastener 42 for supply line 38.

Generally, the present subject matter provides a basin wrench comprising a handle or body and one or more selectively positionable inserts that are either removably engageable with the handle or movably affixed to the handle. The one or more inserts include face(s) that have engagement regions sized and shaped to fittingly engage various faucet components such as those depicted in FIG. 1 for example. In certain versions of the basin wrench, the insert is a multiface insert and includes two engagement regions different from one another. In a particular version, the multiface insert is cube-shaped. In many versions of the basin wrench, the handle includes a hollow interior and a longitudinal slot extending from an end of the handle at which an insert is positioned or engaged. The slot provides access to the hollow interior of the handle. The basin wrench may also include a second insert which is removably engageable with the handle or movably affixed to the handle. In many versions of the basin wrench, the second insert is cylindrical in shape and includes at least one engagement region sized and shaped to engage various faucet components.

According to an embodiment of the present subject matter depicted in FIGS. 5-8, a basin wrench 50 generally includes an elongated wrench body or handle 52 having a generally hour-glass configuration that is axially symmetric about a longitudinal axis 54 (shown in FIGS. 7-8), which is also the primary rotational axis of the basin wrench (described more fully below). The wrench body 52 can be described as generally hollow to define an open interior portion 56 that can receive a water supply line, for example the water supply line 38 depicted in FIG. 1. The wrench body 52 includes a first end 58 and a second opposite end 62. In the depicted embodiment, the ends 58 and 62 of the wrench body 52 are adaptable to operatively engage many different faucet components including, but not limited to, a basin nut, a water supply line nut, a water supply line shut-off valve and a strainer basket for example. A plurality of notches or slots 64 extend generally parallel to the longitudinal axis 54 from the first end 58 towards the second end 62. Similarly, a plurality of second notches or slots 66 extend generally parallel to the longitudinal axis 54 from the second end 62 of the body 52 towards the first end 58. The slots 64 and 66 are configured to engage basin nuts, an example of which being the basin nuts 24 and 26 depicted in FIG. 1. The slots 64 and 66 are appropriately spaced about the circumference, i.e. angularly spaced from one another, so that the slots can engage two-winged nuts, three-winged nuts, four-winged nuts, and six-winged nuts depending on which end 58 or 62 of the wrench body 52 is used to engage the basin nut.

Figure 4:
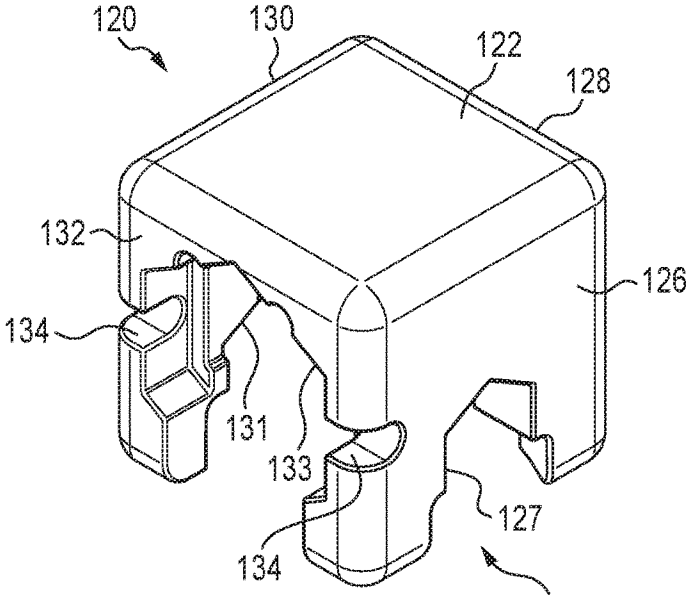
FIGS. 2-4 are perspective views of an embodiment of a cube-shaped first insert used in the present subject matter tool system.
Figure 3:
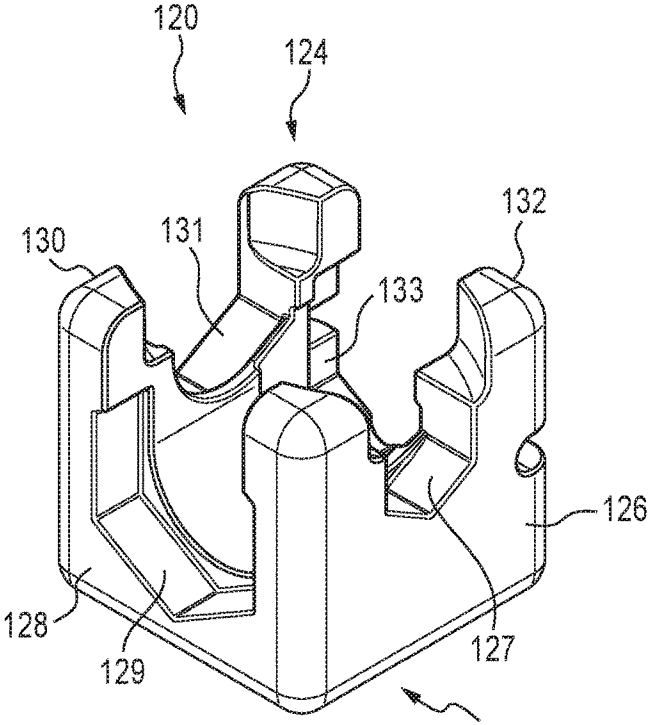
Figure 2:
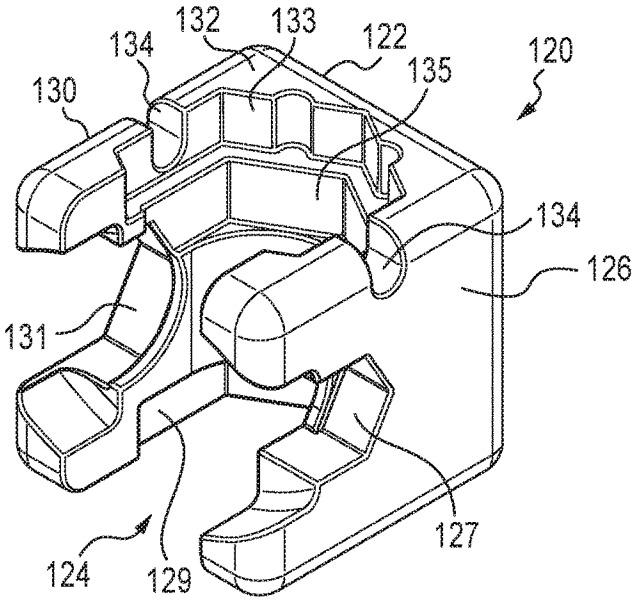
Figure 5:
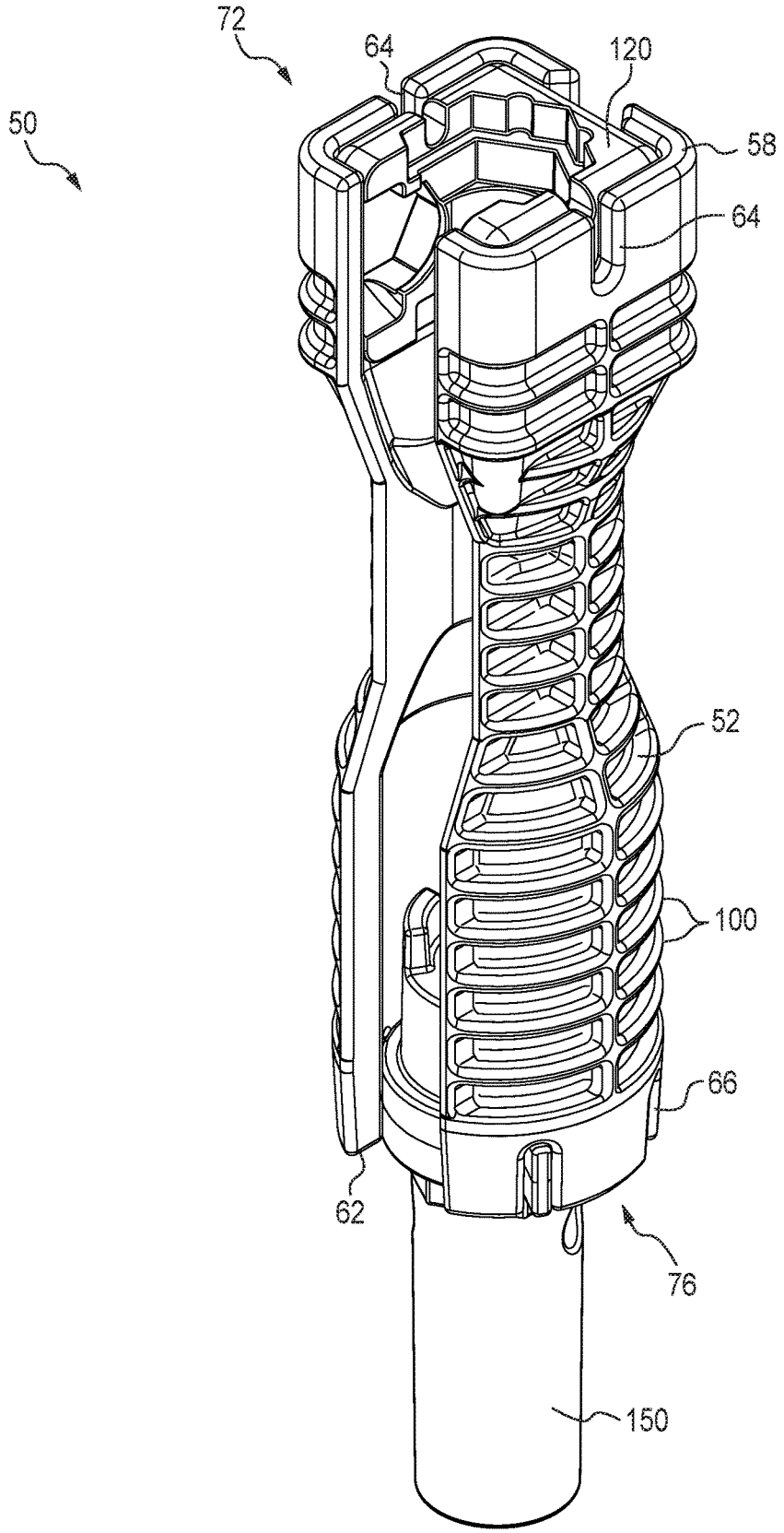
FIGS. 5-6 are perspective views of an embodiment of the tool system having a cube-shaped first insert engaged at one end of a handle, and a cylindrical second insert engaged at another end of the handle.
Figure 6:
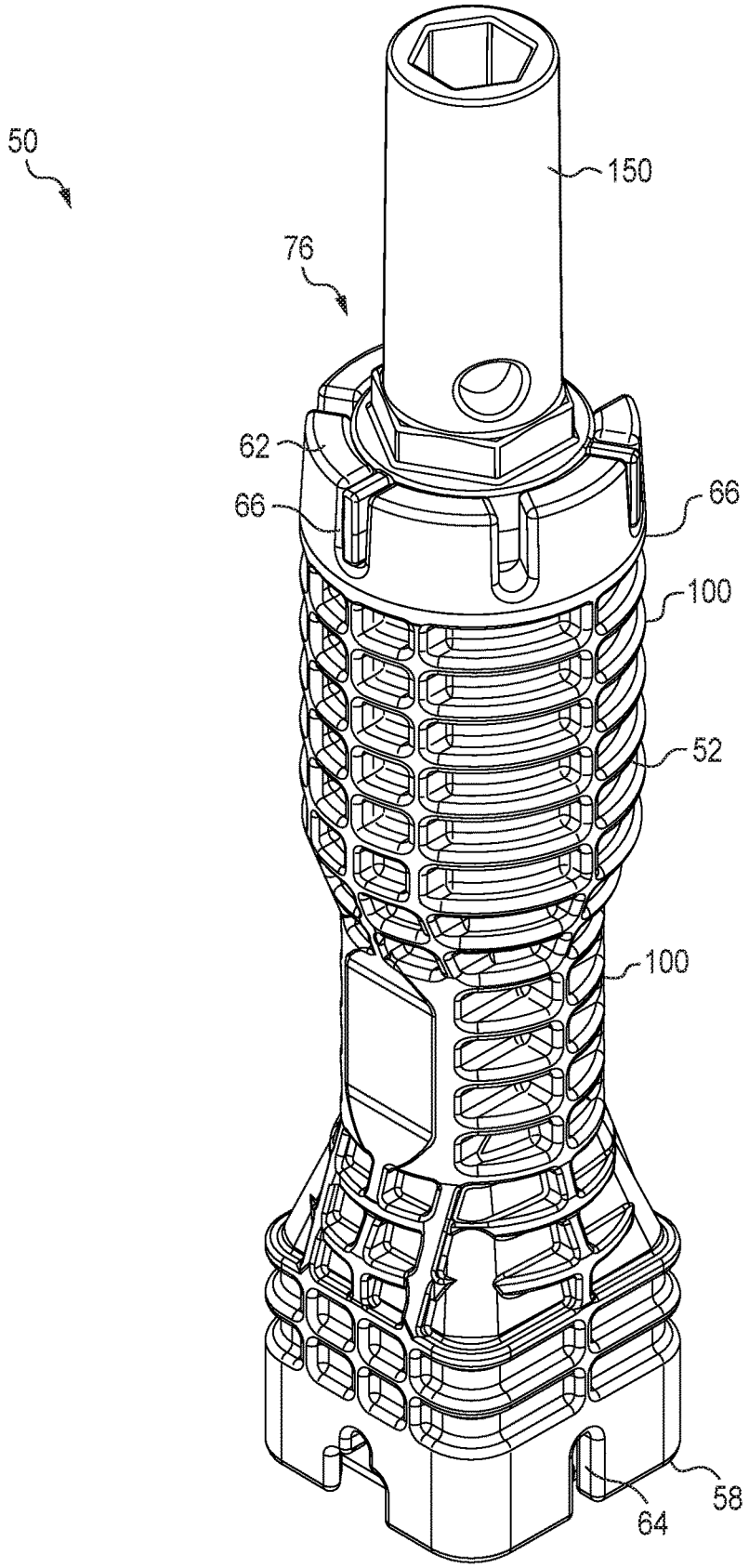

Referring to FIGS. 2-4, a first insert 120 is selectively received inside a first opening 72 (more clearly seen in FIGS. 5 and 7) in the first end 58 of the wrench body 52. In many embodiments, the first insert 120 is in the form of a multiface insert and particularly a cube-shaped insert as described in greater detail herein. Referring to FIGS. 9-12, a second insert 150 is received inside a second opening 76 (more clearly seen in FIGS. 6 and 8) of the second end 62 of the wrench body 52. In many embodiments, the second insert 150 is in the form of an insert having a cylindrical shape as described in greater detail herein. Each insert 120 and 150 can be received by the wrench body 52 in various orientations which will be described in more detail below. The inserts 120 and 150 provide adaptability to the wrench 50 allowing the wrench to be used to engage many different components typically associated with the plumbing in kitchens, bathrooms and the like which are collectively referred to herein as faucet components. Although in the present embodiment the inserts 120, 150 are described as being selectively received inside corresponding respective ends of the wrench body 52, it will be understood that the present subject matter includes versions in which the inserts are not received inside the ends. That is, other variations are contemplated in which one or both inserts are engaged with other regions of the wrench body or handle.

Figure 7:
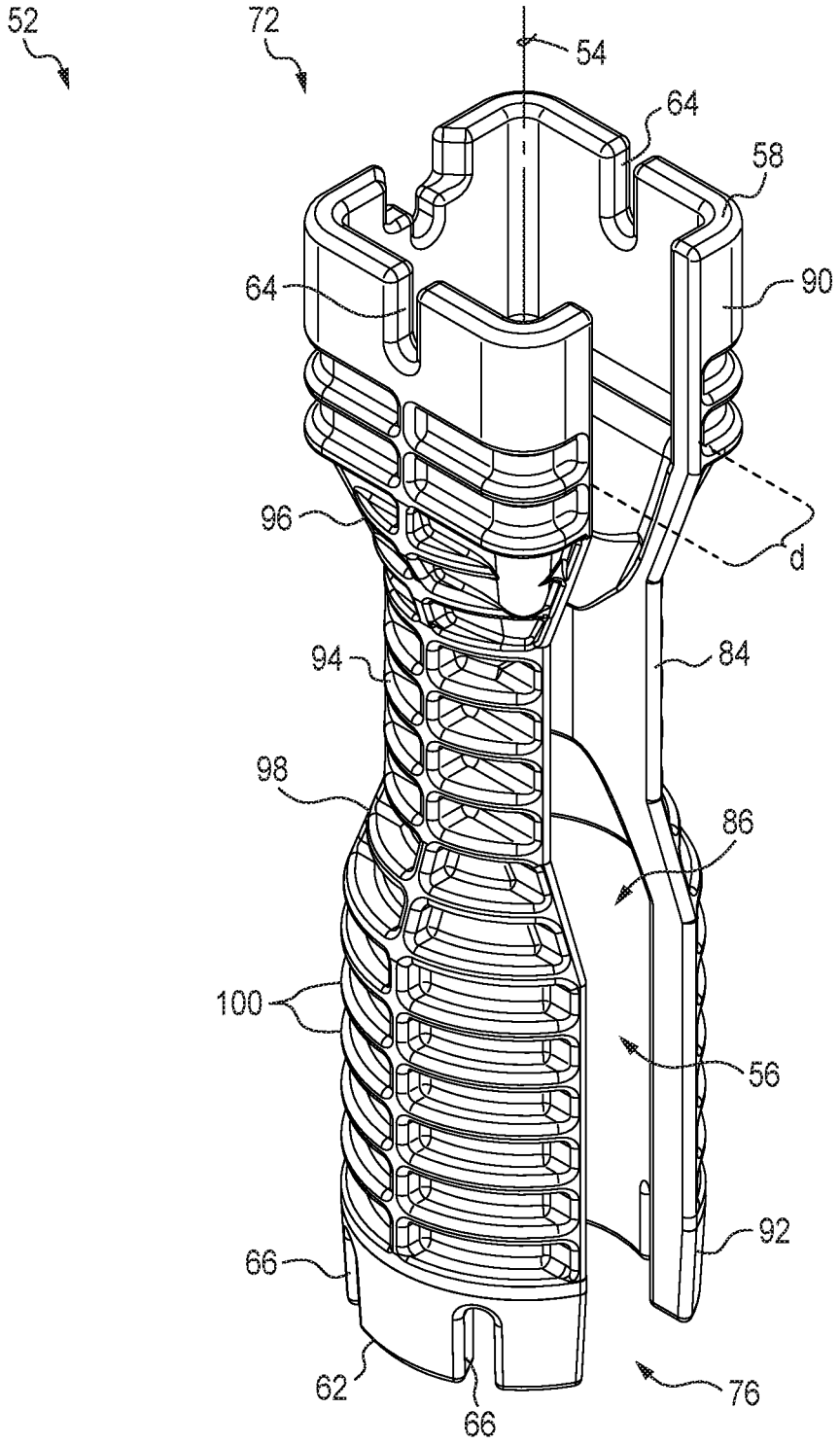
FIGS. 7-8 are perspective views of the handle used in the tool system shown in FIGS. 5-6.
Figure 8:
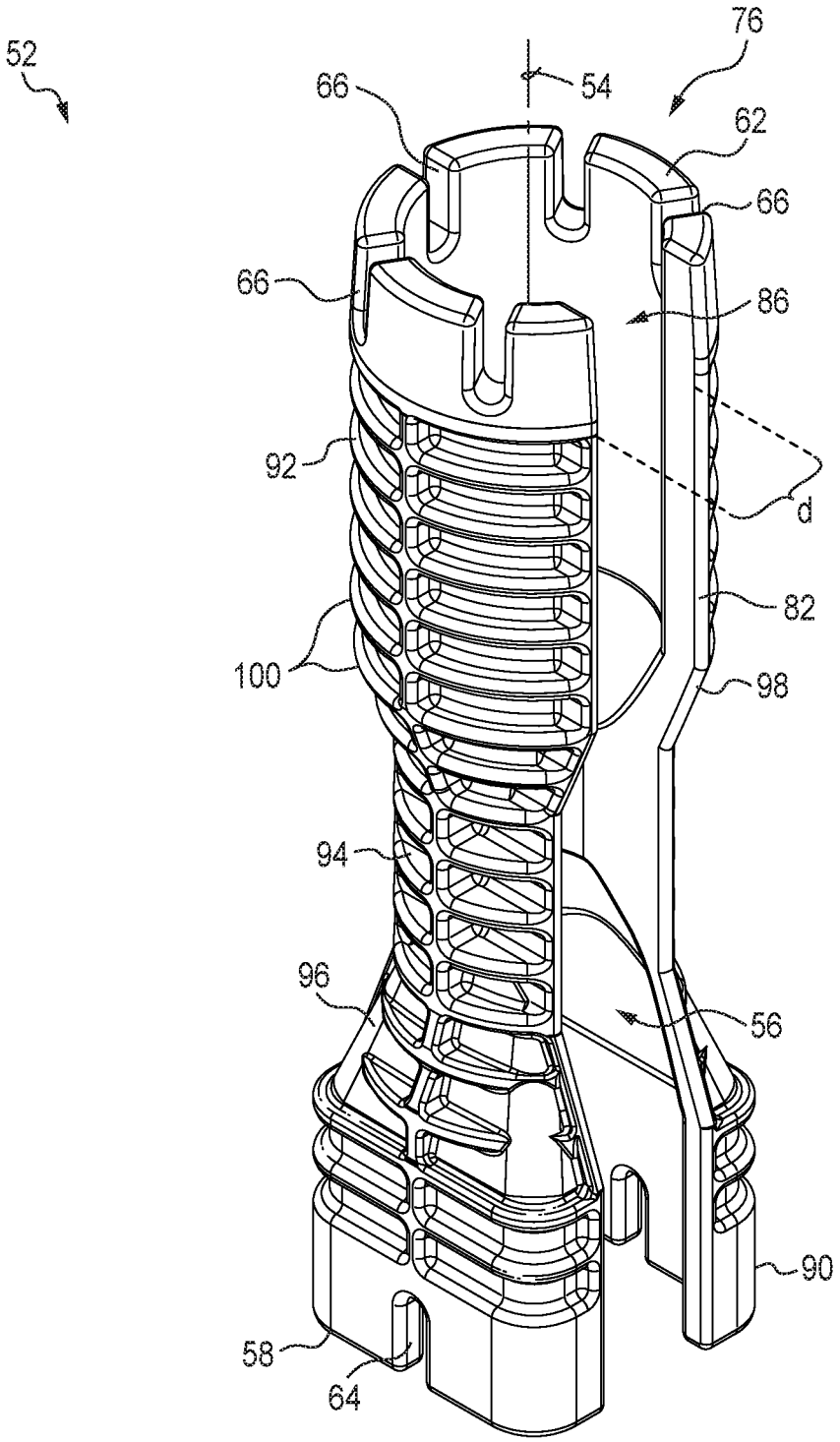
Figure 10:
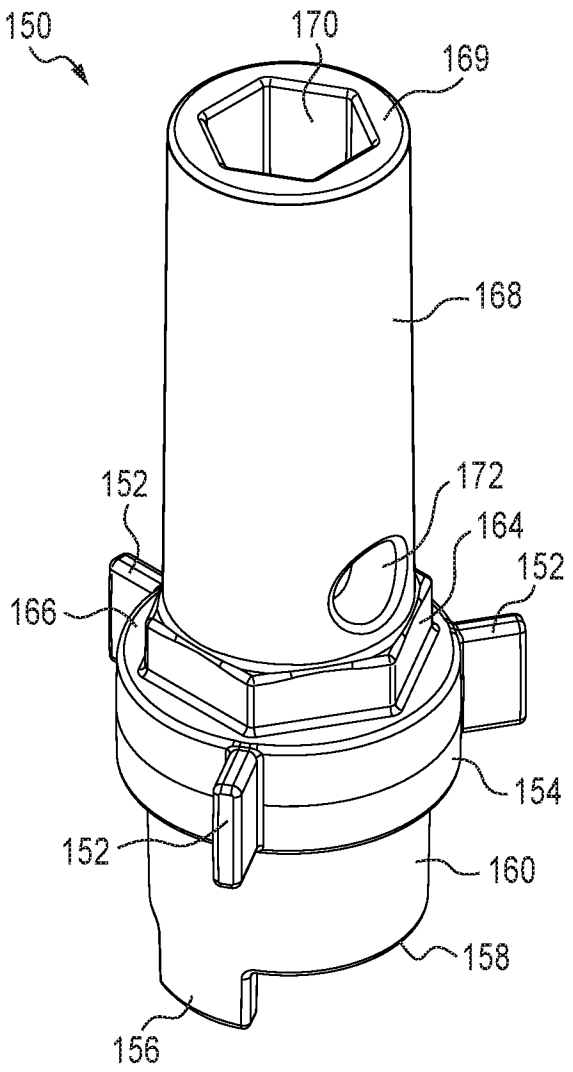
FIGS. 9-12 are views of the cylindrical insert of the tool system shown in FIGS. 5-6.
Figure 9:
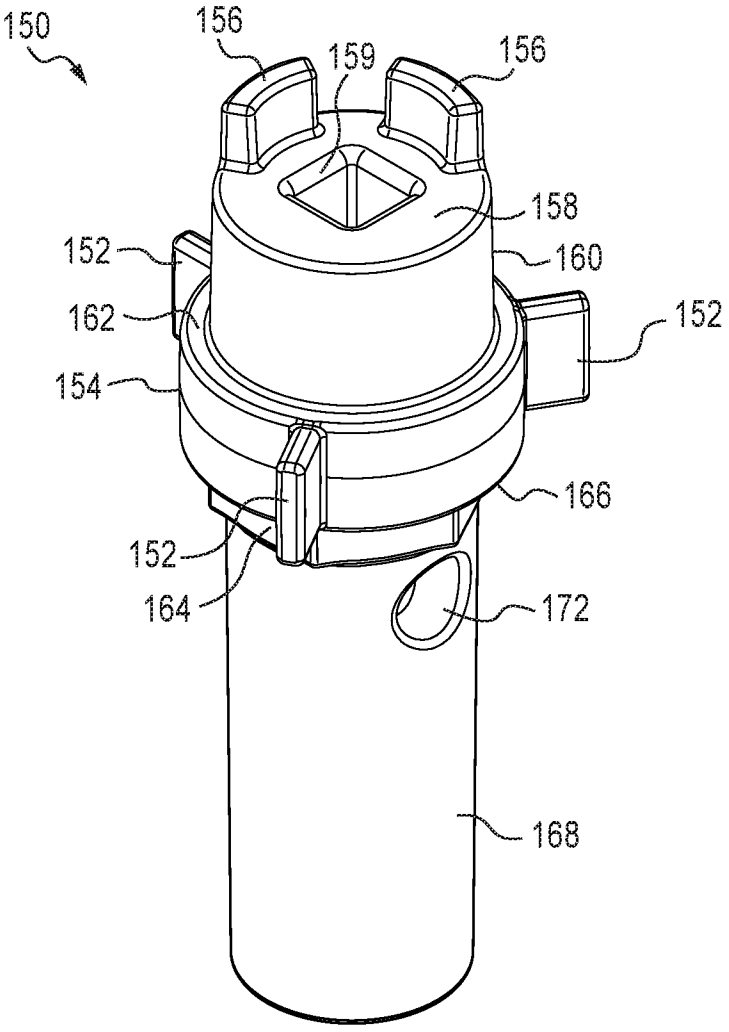
Figure 11:
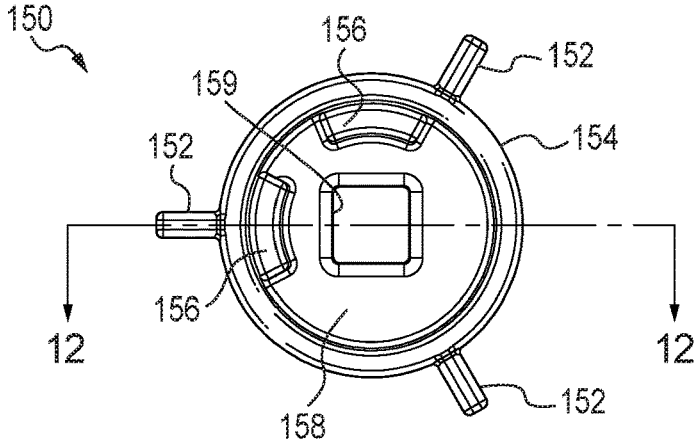
Figure 12:
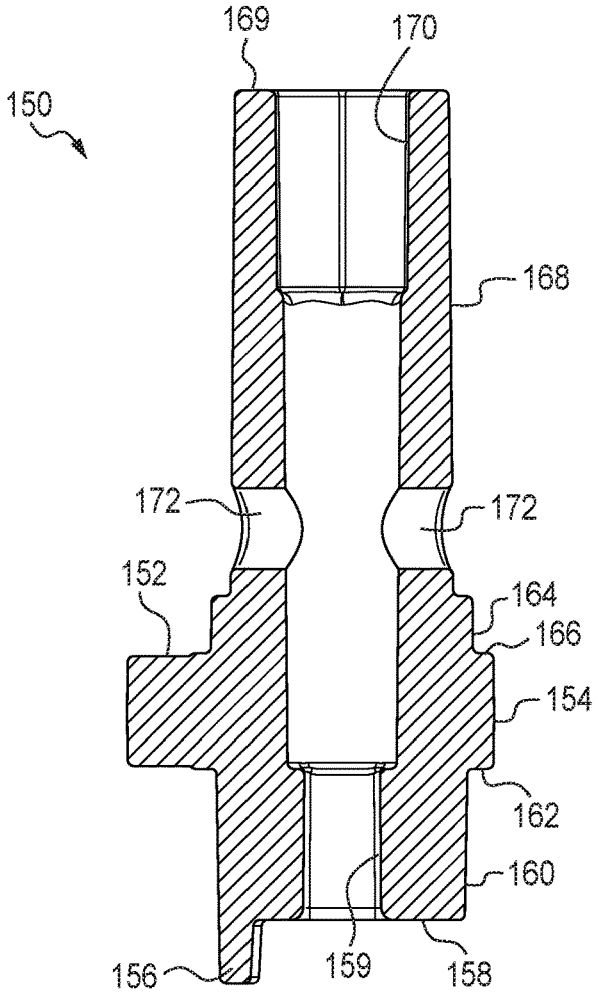

The wrench body 52 has a general C-shaped configuration (or backwards C-shaped configuration) in a cross section taken normal to the longitudinal axis 54. With reference to FIGS. 7-8, the wrench body 52 includes a first longitudinal edge 82 and a second longitudinal edge 84 that are spaced from one another to define a longitudinal slot 86 between them. The slot 86 provides access to a hollow interior of the wrench body 52. In many embodiments, the edges 82 and 84 extend between the ends 58 and 62 of the wrench body or handle 52. The slot 86 can be described as a removed segment from an arcuate side wall when viewed in a cross section taken normal to the rotational axis 54. The distance d (FIGS. 7-8) between the first longitudinal edge 82 and the second longitudinal edge 84 is great enough so that a water supply line, such as the water supply line 38 in FIG. 1, can be received through the slot 86 so that the supply line resides in the hollow interior portion 56 of the wrench body 52 when the wrench 50 is used to tighten or loosen a basin nut (or other component).

Referring further to FIGS. 7-8, in the embodiment depicted, the wrench body 52 includes a first larger outer square section 90 that extends generally from the first end 58 of the wrench body towards the second end 62 and a second larger outer diameter section 92 that extends generally from the second end 62 of the wrench body towards the first end 58. A hand gripping section 94 is generally centrally disposed between the first enlarged section 90 and the second enlarged section 92. A first tapered section 96 provides a transition between the first enlarged section 90 and the hand gripping section 94. A second tapered section 98 provides a transition between the second enlarged section 92 and the hand gripping section 94. The enlarged sections 90 and 92 are provided to engage a basin nut and/or to receive a respective insert. The wrench body 52 narrows at the hand gripping section 94 to provide a smaller exterior diameter to facilitate easier gripping of the wrench 50 to tighten and/or loosen basin nuts (as well as other items) by simply rotating the wrench 50 about its rotational axis 54. The hand gripping section 94 is spaced from the respective ends of the wrench body 52 along the longitudinal axis 54 so that the ends of the wrench body can fit into the confined areas where basin nuts, kitchen spray hoses, toilet ballcocks and the like typically reside while providing an area for the user of the wrench 50 to grip and turn the wrench. The hand gripping section 94 in the depicted embodiment is also long enough, as measured parallel to the longitudinal axis, so that at least a majority of one's hand is accommodated by the hand gripping section.

In certain embodiments, the body 52 may be thicker (taken in a cross section parallel with the longitudinal axis 54) in the area of the hand gripping section 94 as compared to the enlarged sections 90 and 92. Accordingly, the hand gripping section 94 can accommodate radially directed compressive force exerted by the hand of a user as the user rotates the wrench 50 about its rotational axis 54. Such a configuration is desirable since the body 52 includes the longitudinal slot 86 whereby the compressive force applied by one's hand is not carried through the removed segment, i.e. the slot 86, of the circular side wall.

With reference back to FIGS. 5-8, a plurality of circumferential ribs 100 may be provided on an exterior surface of the wrench body 52 to provide additional rigidity to the body 52 while lessening the amount of material from which the wrench body is made. The exterior ribs 100 are disposed in one or more of the larger diameter sections 90 and 92, the tapered sections 96 and 98, and the hand gripping section 94 of the wrench body 52 to reinforce the body when a compressive force is being exerted around the C-shaped wrench body. The ribs 100 can also carry torsional forces that arise from tightening or loosening a nut, or similar component. The exterior ribs 100 also limit the amount of surface area that can become soiled so that one's hand does not slip when one attempts to rotate the wrench 50.

One or more internal ribs (not shown) can also be provided in the hand gripping section 94 or within other regions of the wrench body 52. Such internal ribs may be accessible or visible within the hollow interior 56. The internal ribs can intersect one another and extend at an angle to the longitudinal axis 54 of the wrench 50. The ribs can provide structural integrity to the hand gripping section 94 as well as lessening the amount of material to form the hand gripping section.

With reference to FIGS. 2-4, a first insert 120 is shown and depicted in a cube-shaped form. The first insert 120 is configured to engage ⅞ inch hex supply line nuts, plastic wing supply line nuts, one inch hex basin nuts, and oval handle supply line shut-off valves. If desired, the first insert 120 can be configured to engage nuts or other components having metric dimensions. The insert 120 is configured to engage a wide array of faucet components. In the depicted embodiment, the first insert 120 is formed from a rigid material, for example, metal and/or plastic. The first insert 120 when provided in a cube-shape, defines six working faces 122, 124, 126, 128, 130, and 132. Each working face defines an engagement region that is sized and/or shaped to fittingly engage a nut, fitting, or other hardware or accessory component typically associated with a faucet assembly. In many embodiments, the engagement regions provided on the insert 120 are different from one another. More specifically, in the version of the insert 120 depicted in FIGS. 2-4, the working face 126 defines an engagement region 127 sized and shaped to fittingly engage a faucet component that may be associated with a typical faucet assembly or other assembly. Similarly, the working face 128 defines an engagement region 129 sized and shaped to fittingly engage another component. The working face 130 defines an engagement region 131 sized and shaped to fittingly engage another component. The working face 132 defines an engagement region 133 sized and shaped to fittingly engage another component. The working face 122 may receive and/or be engaged with a hex pocket described in greater detail herein. The working face 124 is configured to engage components such as shut-off valves. The first insert 120 when provided in a cube-shape provides six faces, each of which can be used for different hex sizes, shut-off valves, wing nuts, and the like for example. It will be appreciated that the present subject matter includes other cube-shaped inserts having less than six working faces.

In the present embodiment, the engagement regions 127, 129, 131, and 133 are differently sized and/or shaped from one another. One or more of faces 126, 128, 130, and/or 132 may include a plurality of engagement regions. For example, the face 132 defines the previously noted engagement region 133. The face 132 also defines another engagement region 134 which in the embodiment shown in FIGS. 2-4, is in the form of recesses 134. The recesses 134 are sized and shaped to fittingly engage a wing nut for example. Another example of an engagement region is shown as engagement region 135 accessible from face 132. The engagement region 135 is similar to the previously described engagement region 133 but is sized to fittingly engage a faucet component of smaller dimension than that for the engagement region 133. In many embodiments, one or more engagement regions are configured to receive and fittingly engage a hexagonal nut or other fastener. For such engagement regions, the region typically includes four adjoining planar surfaces oriented at an angle of 60° from one another. As will be understood, such configuration enables the region to radially or laterally engage a hexagonal nut. Such manner of engagement is not possible with a closed-end wrench or socket. The noted configuration of the engagement region(s) also enables axial engagement between the insert and a hexagonal nut.

The first insert 120 is configured to be received inside, within, or along the first end 58 or opening 72 of the wrench body 52. In many embodiments, the insert 120 is sized and shaped to fittingly engage an end such as end 58 or opening 72 of the wrench body 52. Upon positioning the insert 120 within the end 58, the insert 120 may be frictionally engaged therein. It is also contemplated that one or more detents, locking or engagement components, or other retaining provisions can be used to promote retention of the insert 120 within the end 58 or opening 72 of the wrench 50.

The second insert 150 is configured to be received inside the second end 62 or second opening 76 of the wrench body 52. With reference to FIGS. 9-12, the second insert 150 when provided in a cylindrical shape, includes a plurality of radial tabs 152 that radiate or extend from a periphery of a cylindrical portion 154. The radial tabs 152 are configured to be received inside the slots 66 formed in the second end 62 of the wrench body 52. The slots 66 are angularly spaced from one another differently than the slots 64 in the first end 58 of the wrench body 52 so that the first insert 120 is not mistakenly inserted into the second opening 76 of the body 50 and vice versa. The slots 64 are angularly spaced from one another differently than the slots 66 also so that the slots at one end are configured to engage a basin nut having a first configuration and the slots at the other end are configured to engage a basin nut having a second configuration. The second insert 150 can attach to the second end 62 of the wrench body 52 in other manners, for example, the second end of the wrench body can have a polygonal or non-circular opening that matches a polygonal or non-circular configuration that can be formed on the second insert 150, or the second insert, or adapter member, can connect to the wrench body 52 without being received in the second opening.

With continued reference to FIGS. 9-12, the second insert 150 also includes a plurality of axially extending tabs 156 that extend from a generally planar end surface 158 of a smaller diameter section 160 (as compared to the aforementioned cylindrical portion 154). The insert 150 defines an engagement region 159 configured to receive a drive member (not shown) from a tool or other component. The smaller diameter section 160 extends from a first circular face 162 of the cylindrical portion 154 and is aligned coaxial therewith. In the depicted embodiment, two axially extending tabs 156 extend from the end surface 158 and are angularly spaced approximately 90° on center from one another (see FIG. 11). The tabs 156 are spaced from one another in a manner such that the second insert tool 150 can engage a strainer basket, which is typically used in a kitchen sink.

The second insert 150 also includes an integral hexagonal boss 164 extending from a second circular face 166 that is located opposite the first circular face 162. The hexagonal boss 164 is configured to be received by an associated wrench so that, if desired, the wrench body 52 (and the inserts 120 and 150) can be rotated using the wrench. A cylindrical boss 168 extends coaxially from the hexagonal boss 164 and includes a radial through bore 172. The radial through bore 172 can receive a bar that can be used as a tool for rotating the basin wrench. If the insert 150 is used to provide additional torque via a wrench or bar, the second insert 150 is inserted into the wrench body 52 in a first orientation where the hexagonal boss 164 and the cylindrical boss 168 extend axially from the second end of the body. The cylindrical boss 168 also defines an end face 169 that typically also includes an engagement region 170 configured to receive and engage a basin nut or other component. In many embodiments, the engagement region 170 is in the form of a hexagon. The second insert 150 can be inserted in a second orientation (see FIGS. 15-16) where the tabs 156 extend from the second end 62 of the wrench body 52 in applications in which the wrench 50 is used to engage a strainer basket. In the particular embodiment of the second insert 150 described herein, the axially extending tabs 156 are another form of an engagement region that is sized and shaped to fittingly engage a faucet component.

The second insert 150 can also be used independently of the basin wrench 50. In such an instance, the second insert 150 would be removed from the wrench body 52 and the axially extending tabs 156 would be inserted into openings in a strainer basket. The hexagonal boss 164 and/or the radial through bore 172 would be engaged by a tool, e.g. a conventional wrench or bar, to rotate the second insert 150, and in turn, the strainer basket. In addition or alternatively, the insert 150 can be used by engaging a nut with the engagement region 170 and then rotating the insert 150 about its longitudinal axis using a wrench or other tool engaged at the square-shaped region 159.

Figure 13:
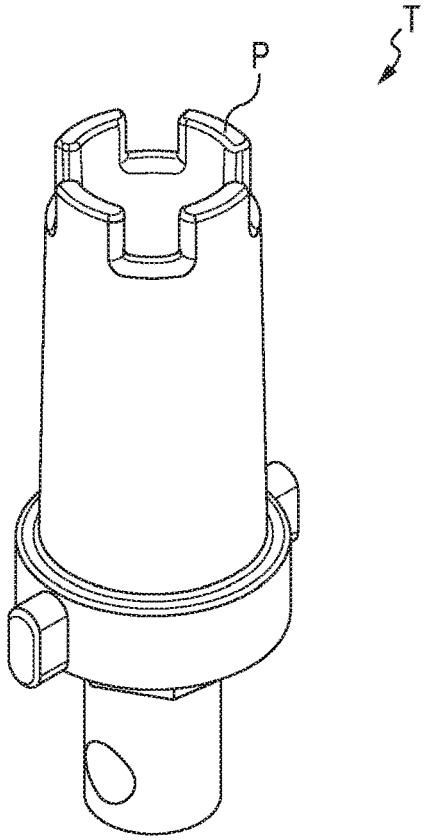
FIG. 13 (PRIOR ART)
FIGS. 13-14 are views of a prior art tool and its engagement with a conventional four pocket strainer basket.
Figure 14:
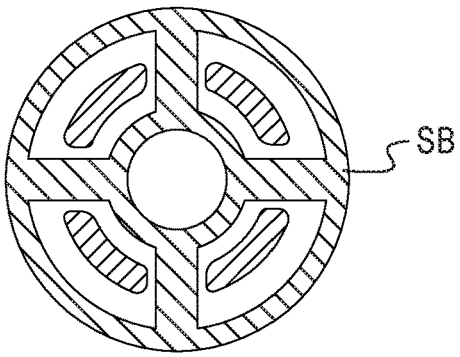
FIG. 14 (PRIOR ART)

As shown in FIGS. 13-14, it is known to engage a strainer basket SB using four projections P of a tool T. The projections P are identical in size and shape and equally spaced from one another around the periphery of an end of the tool T. The projections P are configured to be inserted within the openings of a conventional four pocket strainer basket SB. Although satisfactory in many regards, the tool T can not be used with strainer baskets having configurations different from a four pocket strainer basket.

Figure 15:
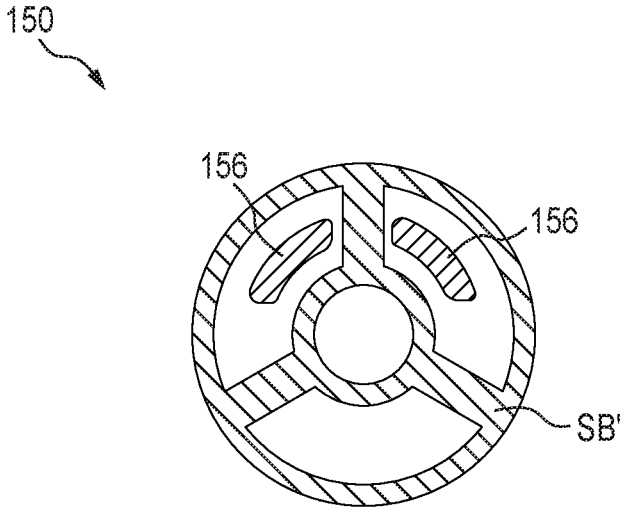
FIGS. 15-16 illustrate engagement between the cylindrical insert depicted in FIG. 9 and a three pocket strainer basket and a four pocket strainer basket.
Figure 16:
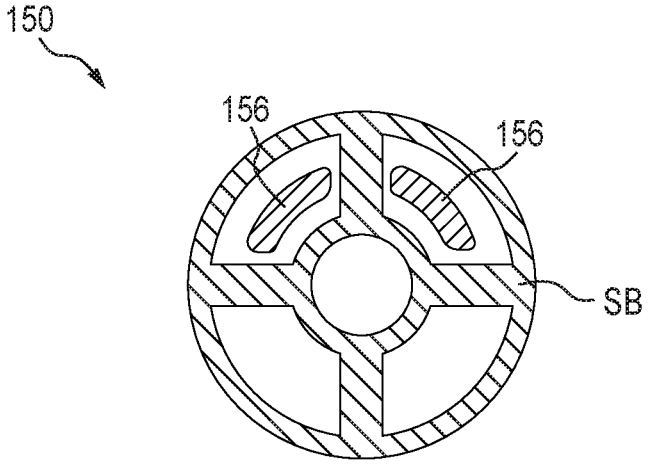

Referring to FIGS. 15-16, the second insert 150 having two axially extending tabs 156, can be used to engage both a three pocket strainer basket SB' as shown in FIG. 15 and a four pocket strainer basket SB as shown in FIG. 16. Moreover, it is contemplated that the second insert 150 could also be used to engage strainer baskets having other configurations besides those depicted in FIGS. 15-16.

Figure 17:
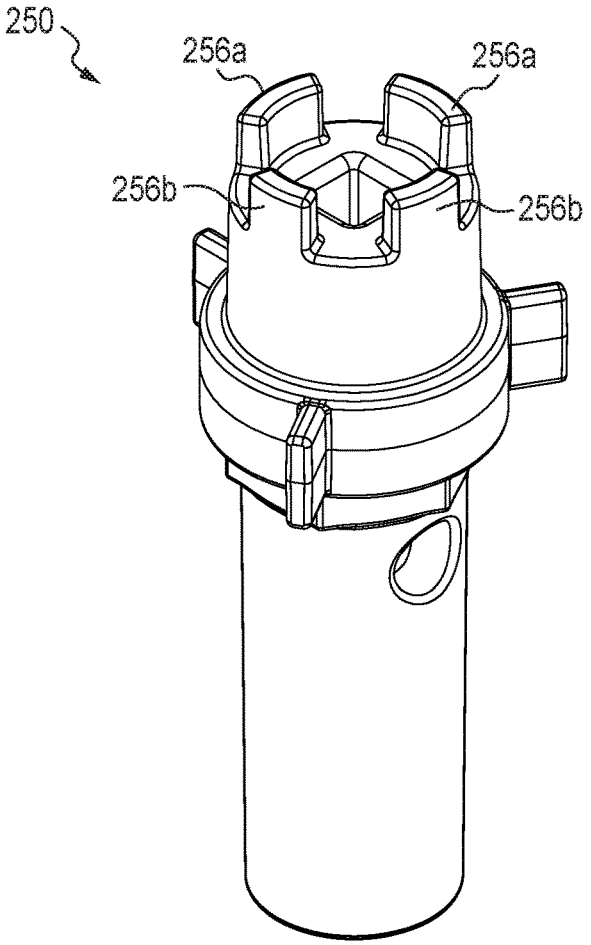
FIGS. 17-19 illustrate another embodiment of a cylindrical insert for use with the tool system of the present subject matter.
Figure 18:
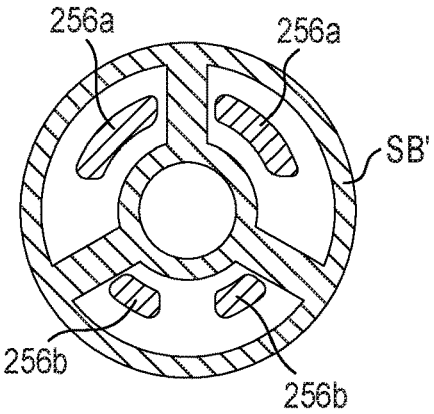
Figure 19:
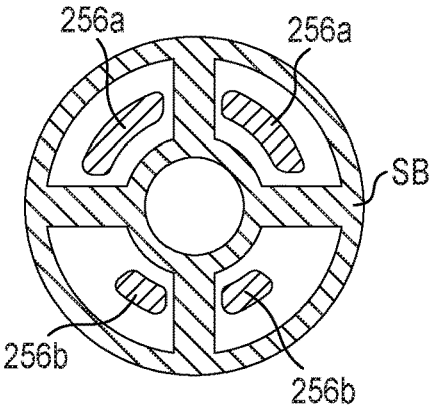

FIGS. 17-19 illustrate another embodiment of a cylindrical insert 250 for use with the tool system of the present subject matter. The insert 250 includes many aspects and features as generally described in association with the insert 150 of FIGS. 9-12 and so for purposes of brevity are not again described. However, the insert 250 includes a different configuration of plurality of axially extending tabs. Specifically, the insert 250 includes a first pair of tabs **256*a* and a second pair of tabs 256*b*. Each tab 256*a* is larger than the tab 256*b*, i.e., has a longer arcuate length. However, in many embodiments the tabs 256*a* and 256*b* have heights or axial dimensions equal to one another. The tabs 256*a* and 256*b* are configured to engage both a four pocket strainer basket SB and a three pocket strainer basket SB' as shown. Although the insert 250** has been described in conjunction with two pairs of identical tabs, it will be understood that the present subject matter includes a wide array of other configurations and combinations of tabs.

Figure 20:
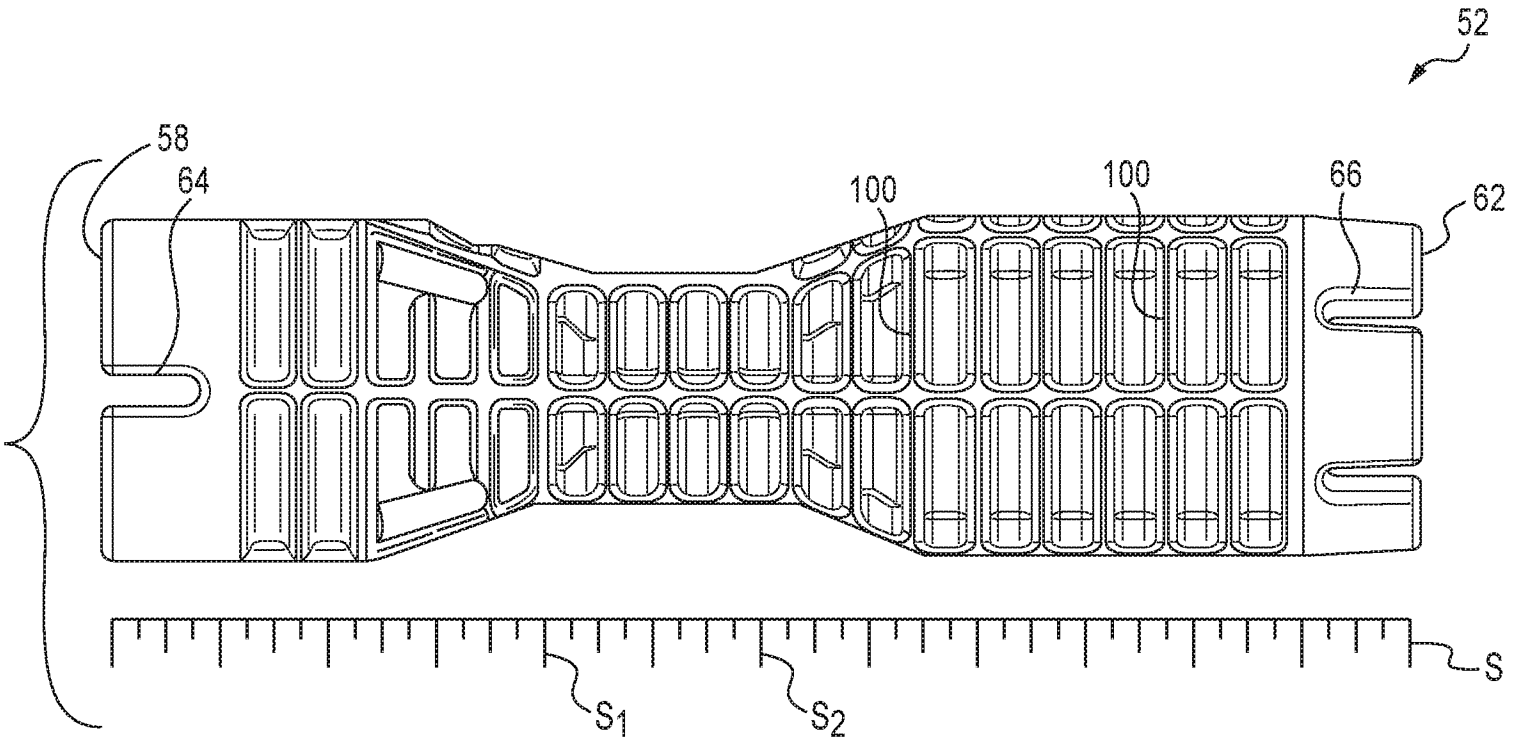
FIG. 20 is a side view of the handle the tool system of the present subject matter.
Figure 21:
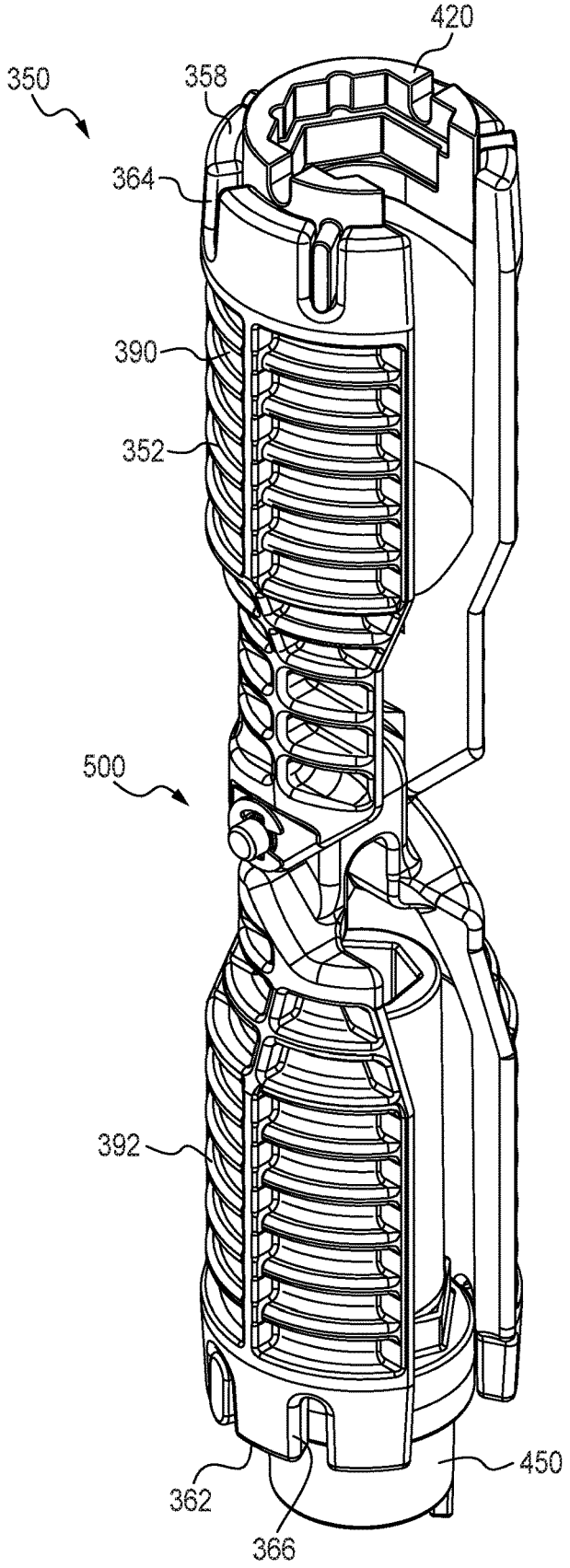
FIGS. 21-22 illustrate another embodiment of a pivoting tool system of the present subject matter.
Figure 22:
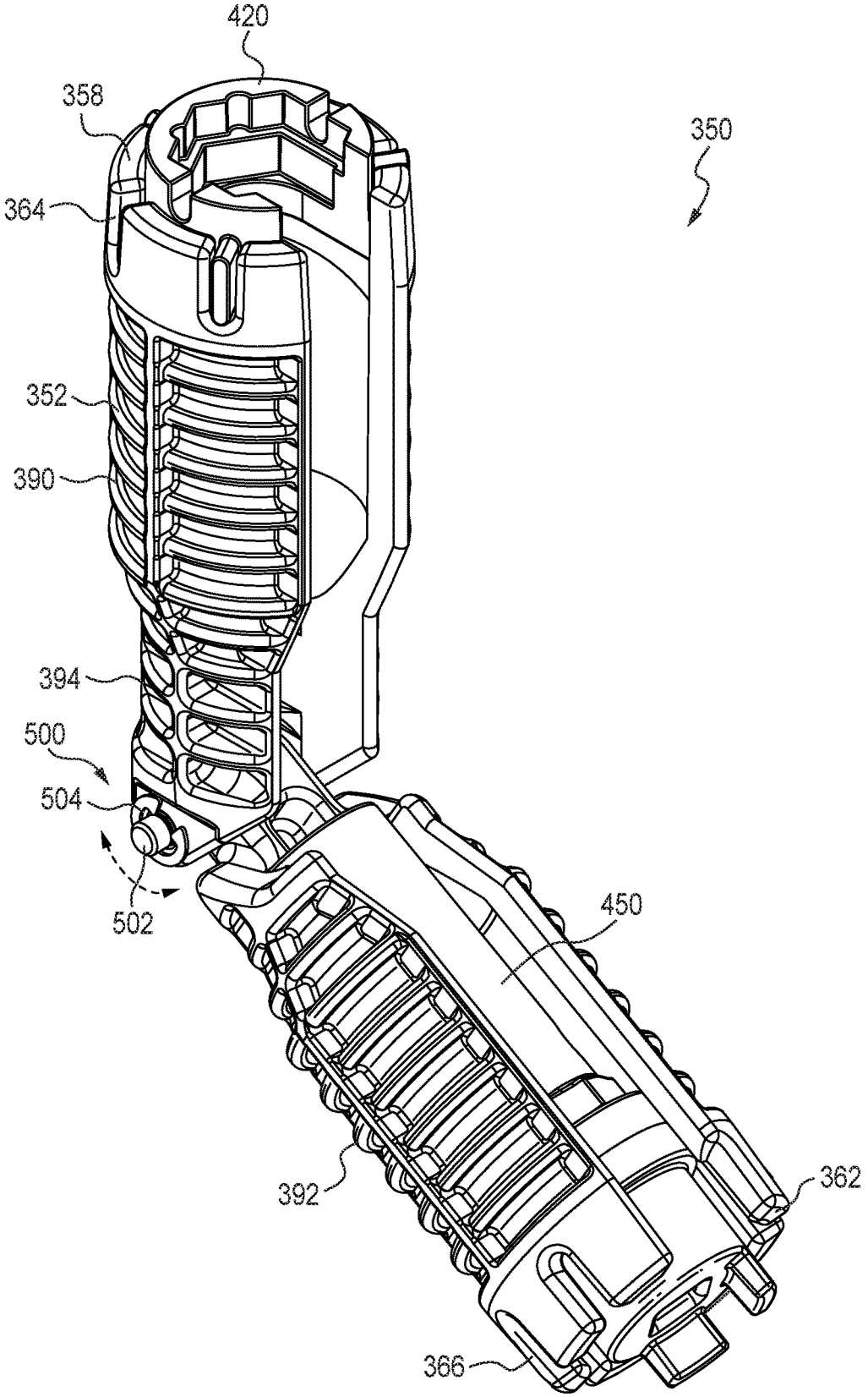
Figure 23:
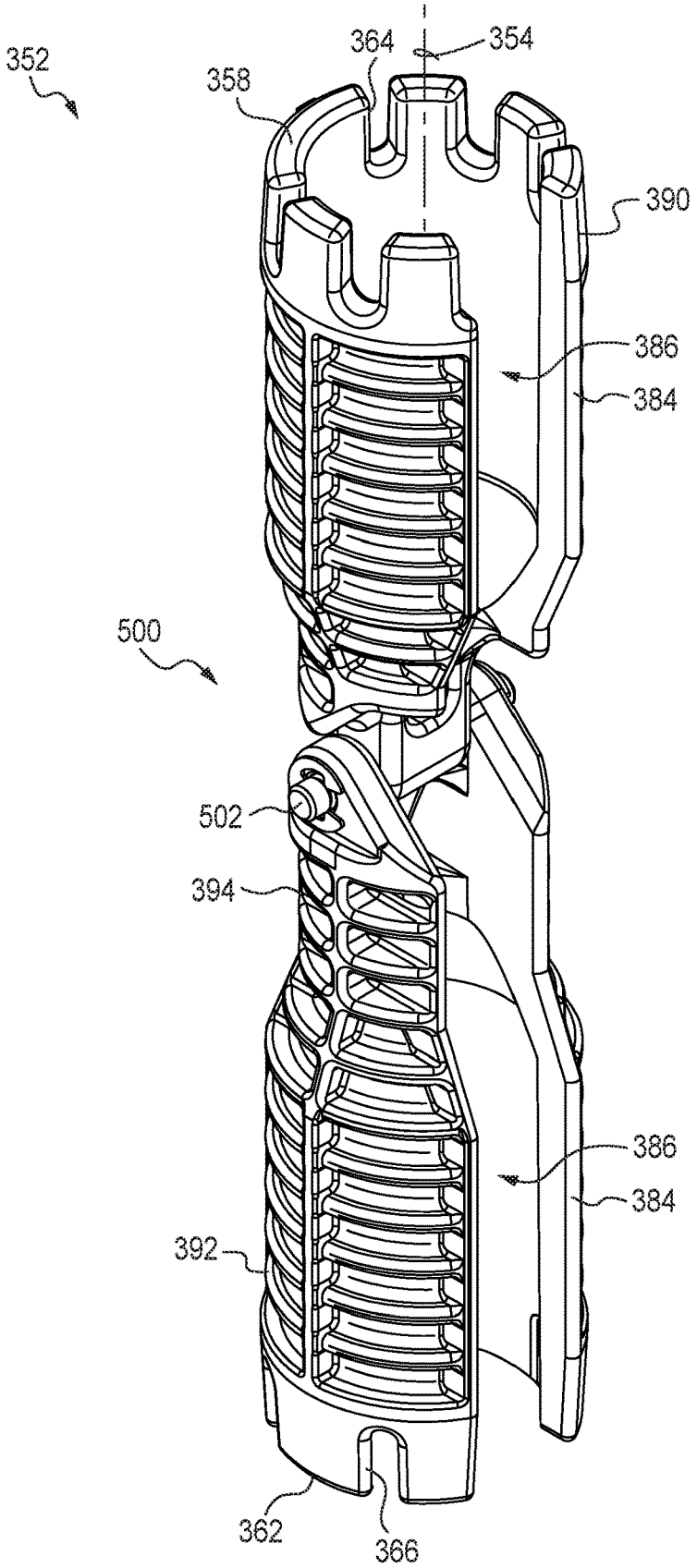
FIGS. 23-25 illustrate additional aspects of a handle used in the pivoting tool system of FIGS. 21-22.
Figure 24:
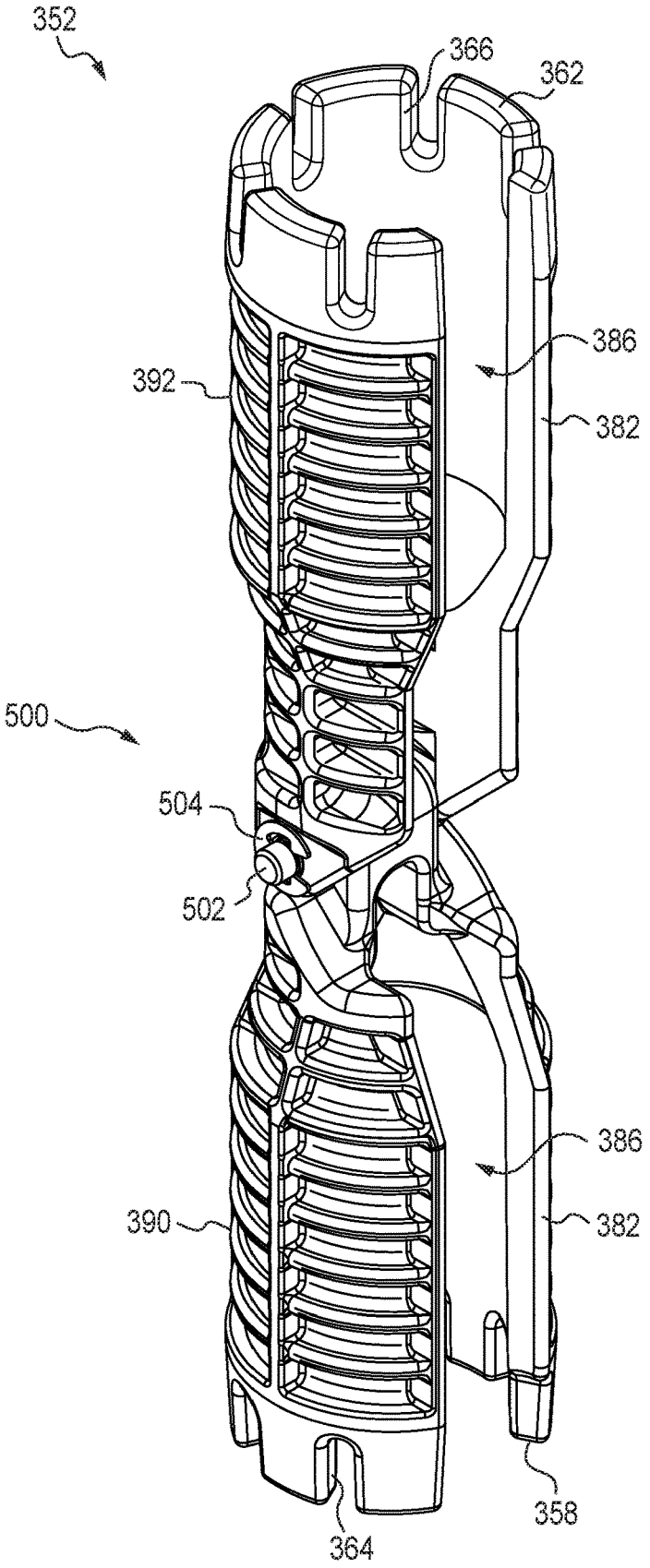

FIG. 20 is a side view of the handle 52 of the embodiment of the tool system previously described in conjunction with FIGS. 5-8. The handle 52 may be sized and/or configured such that one or more of (i) the overall length of the handle, (ii) a portion of the length of the handle, and/or a length of a region or component of the handle, corresponds to or is identical to a known dimension S or subdimension $S_1$ or $S_2$ for example. For examples, the length or depth of a slot 64 or 66 may correspond to a particular dimension. Or, the spacing between ribs 100 may correspond to a known dimension. A user of the tool may then use the handle 52 as a measuring tool to quickly assess dimensions associated with a fixture or plumbing application.

Another embodiment of a tool system or basin wrench 350 in accordance with the present subject matter is shown in FIGS. 21-25. The basin wrench 350 includes many aspects and features and generally described in association with the basin wrench 50 of FIGS. 5-8 and so for purposes of brevity are not again described. The basin wrench 350 includes an elongated wrench body 352 having a pivot assembly 500 generally located at a midsection or within a hand gripping section 394 which is generally centrally disposed between enlarged sections 390 and 392. The body or handle 352 defines opposite ends 358 and 362. Each end defines a plurality of notches 364 and 366 as generally described for notches 64 and 66. The handle 352 defines longitudinal edges 382 and 384 spaced apart to define a receiving slot 386 as similarly described with respect to edges 82 and 84, and slot 86. The longitudinal edges 382, 384 and slot 386 are provided on both handle portions, i.e., on opposite sides of the pivot assembly 500. The wrench 350 also includes a first insert 420 and a second insert 450. Either or both of the inserts 420, 450 can be the same or different from previously described inserts 120 and 150. Although the embodiment of the wrench 350 depicted in the referenced figures utilizes two cylindrically shaped inserts 420, 450, it will be understood that the present subject matter includes the use of the previously described cube-shaped insert 120 for either or both of the inserts 420 and/or 450. For such versions of the basin wrench, one or both ends 358 and/or 362 would include or be in the form of a square section such as previously described enlarged section 90 of the basin wrench 50 of FIGS. 5-8.

Figure 25:
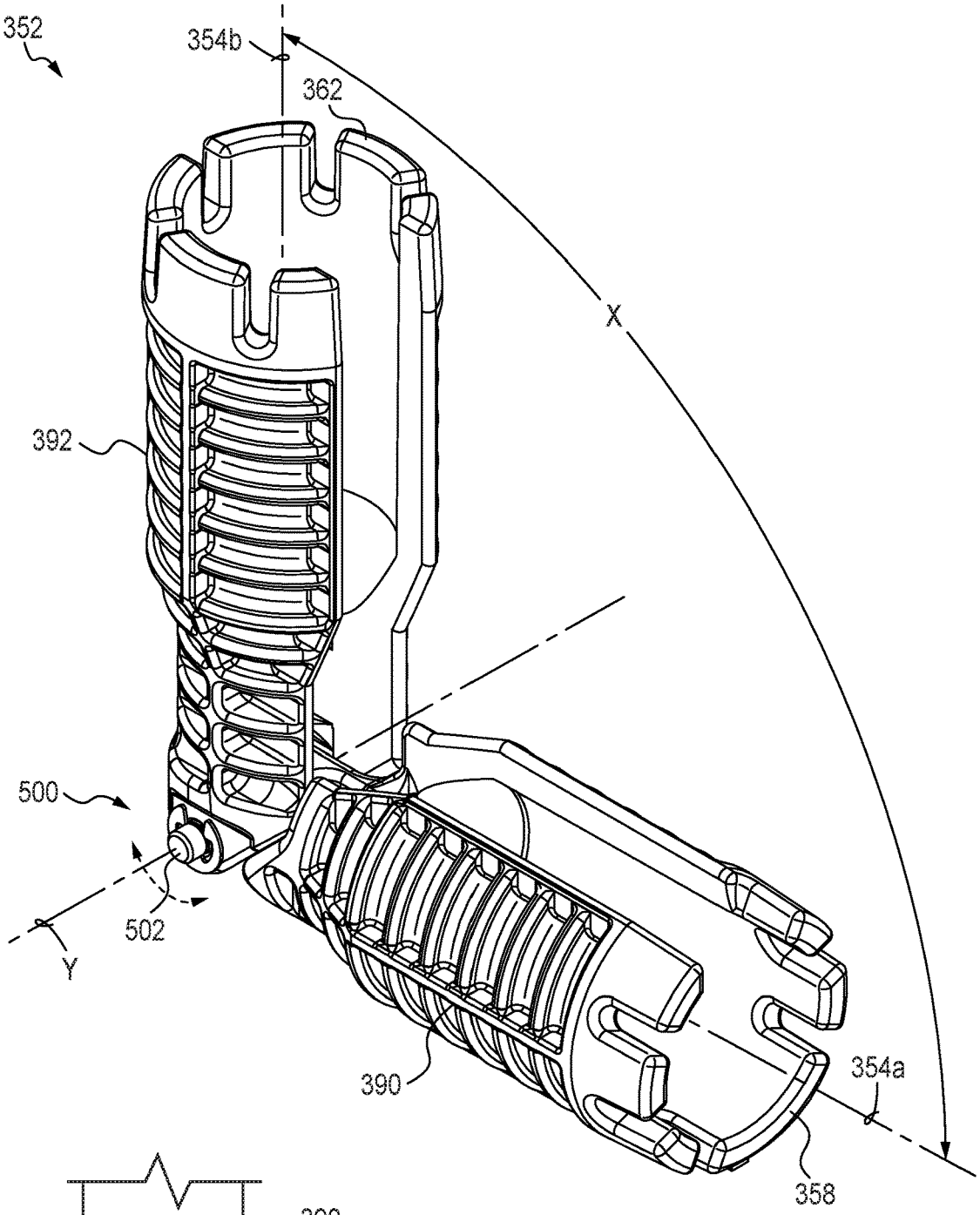
Figure 25A:
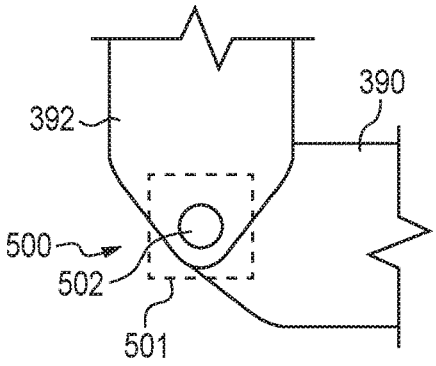
FIG. 25A schematically illustrates locking provisions in an embodiment of the present subject matter.

The pivot assembly 500 generally includes a pivot pin 502 that extends through receiving regions defined in corresponding regions of the hand gripping section 394. The pivot assembly 500 may also include one or more retention members such as retaining washers 504 that serve to maintain engagement of the pin 502 with the noted handle sections. As best shown in FIG. 25, pivot assembly 500 is configured to enable the handle 352 to be pivoted or positioned about pivot axis Y such that a longitudinal axis 354*a* of the enlarged section 390 extends at an angle X from a longitudinal axis 354*b* of the enlarged section 392. Generally, the pivot assembly 500 enables one portion of the handle to be pivoted with respect to a section portion of the handle. In many versions of the present subject matter, the angle X is from about 30° to about 150° and typically 90°. Locking provisions 501 (see FIG. 25A) and/or selectively releasable provisions can be provided in association with the pivot assembly 500 such that once the handle 352 is positioned to a desired angle such as 90°, the handle configuration can be selectively locked in place until the user wishes to place the handle 352 in a longitudinal configuration such as shown in any of FIGS. 21, 23, and/or 24. The present subject matter includes the use of a wide array of locking provisions enabling the pivot assembly to be secured in a desired angular orientation. As shown in FIG. 25, the handle end 390 can be used to provide additional torque or leverage to end 362 without the use of an external wrench or bar.

Figure 27:
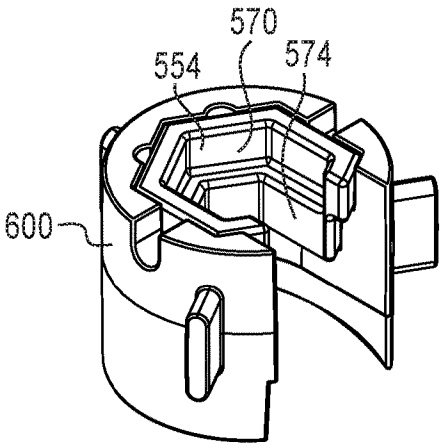
FIGS. 26-28 illustrate an adapter that can be used in the present subject matter tool system.
Figure 28:
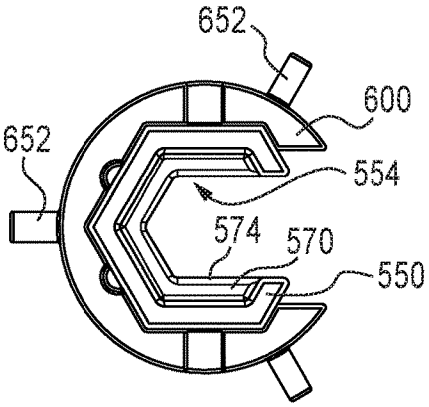
Figure 26:
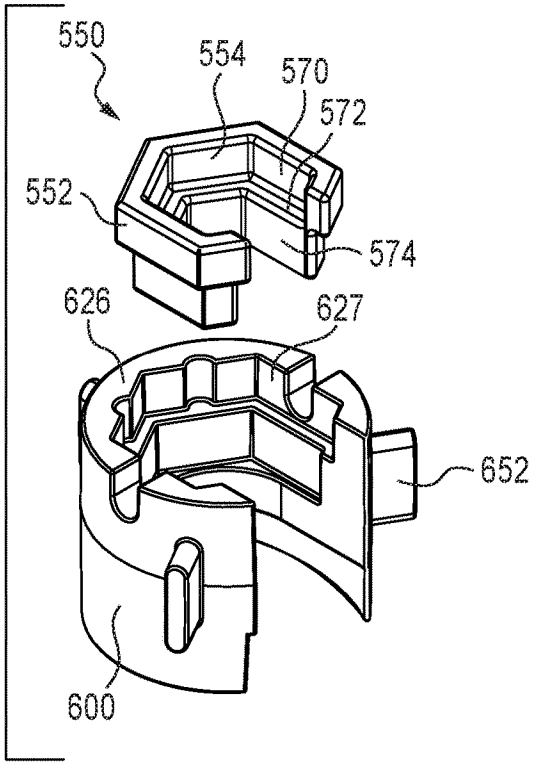
Figure 30:
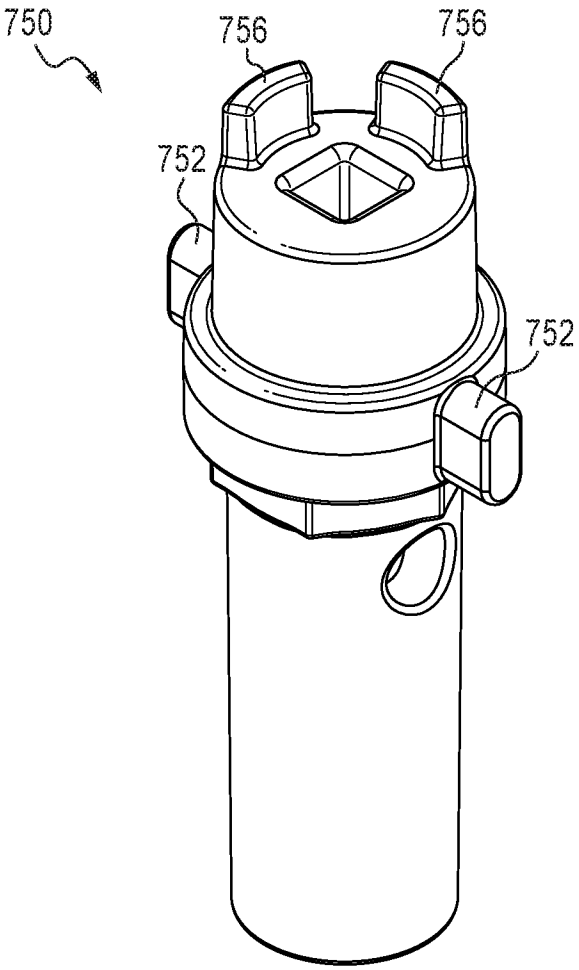
FIGS. 29-32 illustrate another embodiment of a cylindrical insert for use in the present subject matter tool system.
Figure 29:
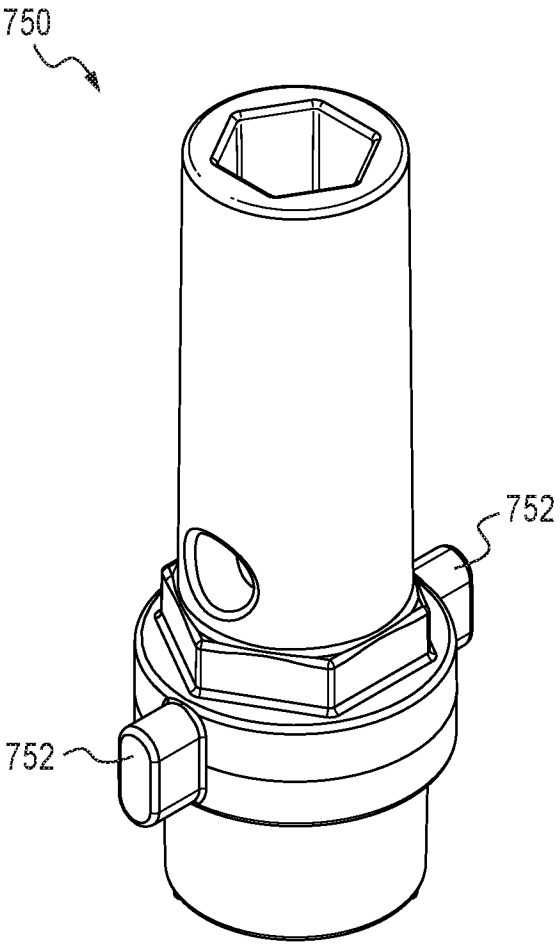
Figure 31:
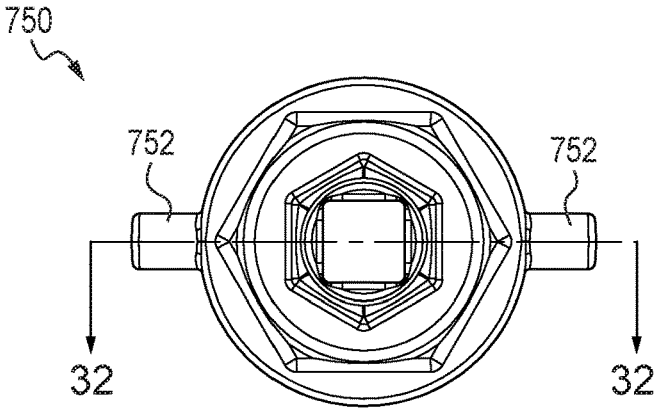
Figure 32:
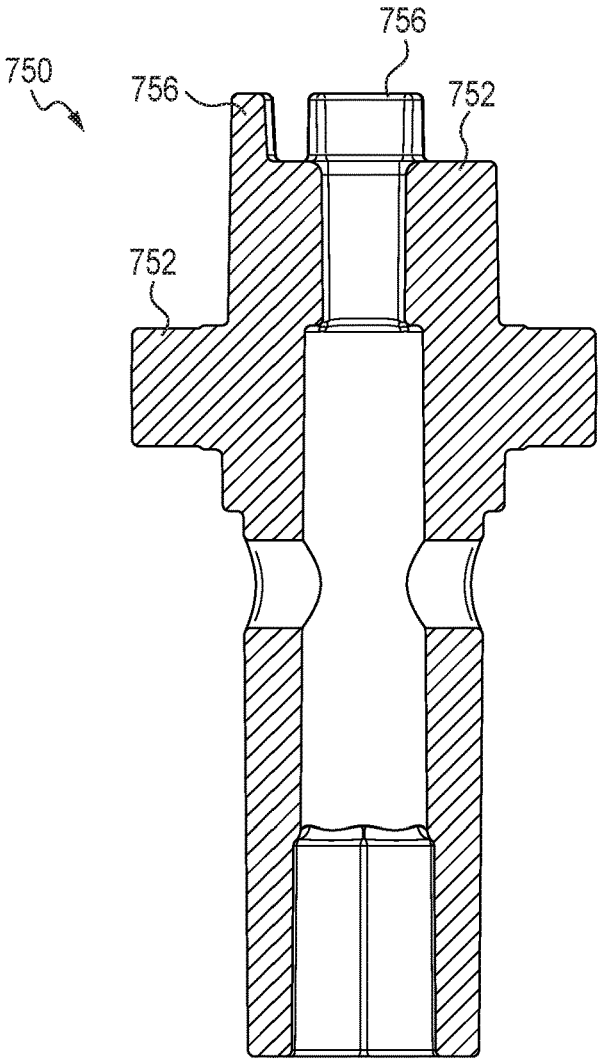
Figure 33:
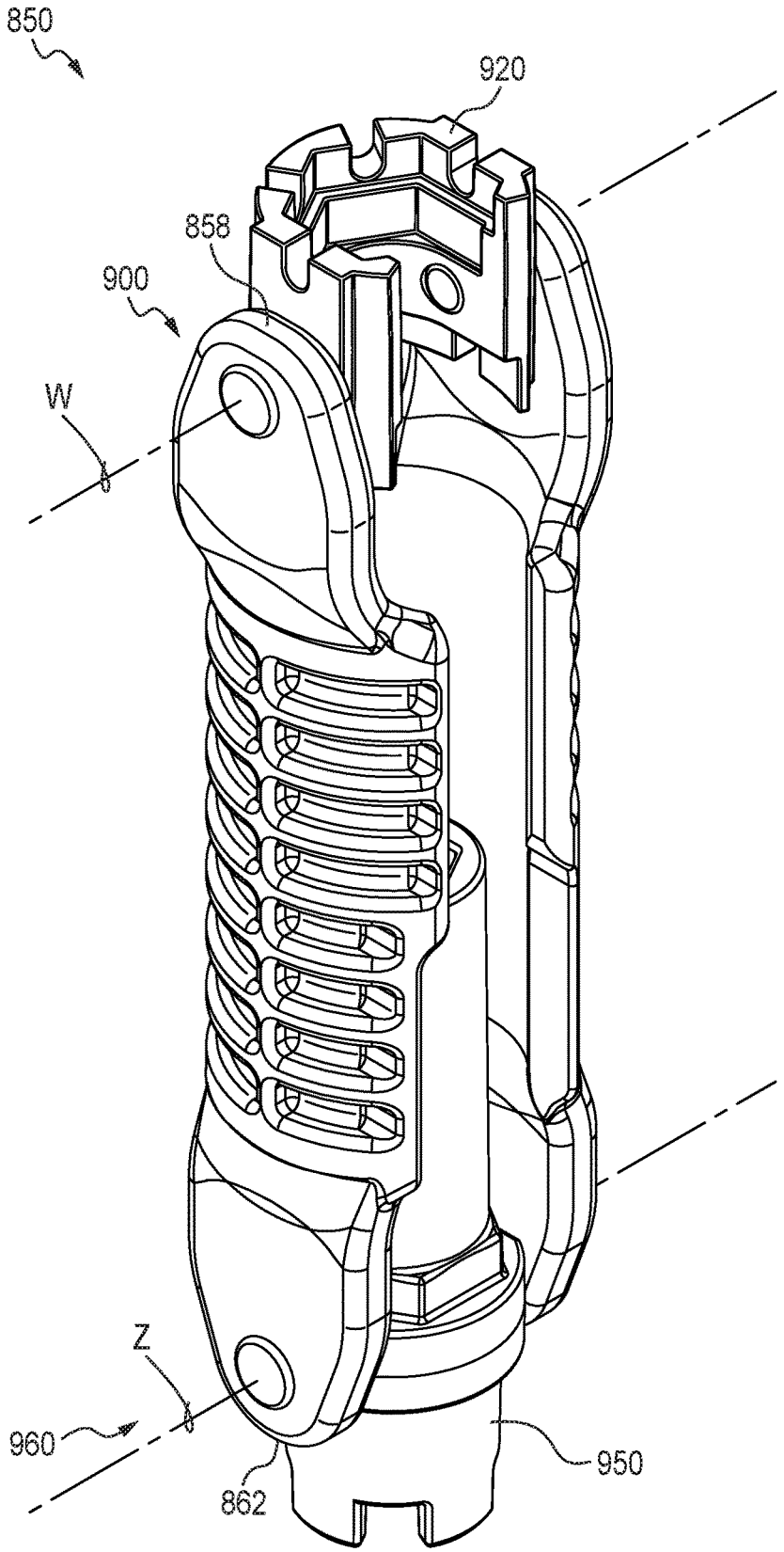
FIGS. 33-35 illustrate another embodiment of the tool system utilizing a handle with pivotally affixed inserts in accordance with the present subject matter.

FIGS. 26-28 illustrate an adapter 550 that can be used with the present subject matter tool system or component thereof, such as in association with an insert 600. The insert 600 is similar to previously described inserts 120, 150, 250, 420, and 450. The insert 600 may include one or more radially extending tabs 652. In the illustrated embodiment, the insert 600 includes three such tabs 652 equally spaced around the outer periphery or circumference of the insert 600. The insert 600 also defines at least one face having 626 defining an engagement region 627 sized and shaped to fittingly engage a faucet component.

The adapter 550 defines an outer periphery 552 and an inner periphery 554. The outer periphery 552 is configured to be fittingly engaged with the engagement region 627 of the insert such as insert 600. The inner periphery 554 of the adapter is sized and shaped to fittingly engage a faucet component or other hardware or accessory. The adapter 550 is used in applications in which the engagement region 627 of the insert 600 is too large or otherwise does not correspond to the faucet component of interest. By selecting an adapter having an inner periphery 554 corresponding to the faucet component of interest and then positioning the adapter 550 within the engagement region 627 of the insert 600, a user can then engage the faucet component using the insert 600 and the adapter 550.

Figure 35:
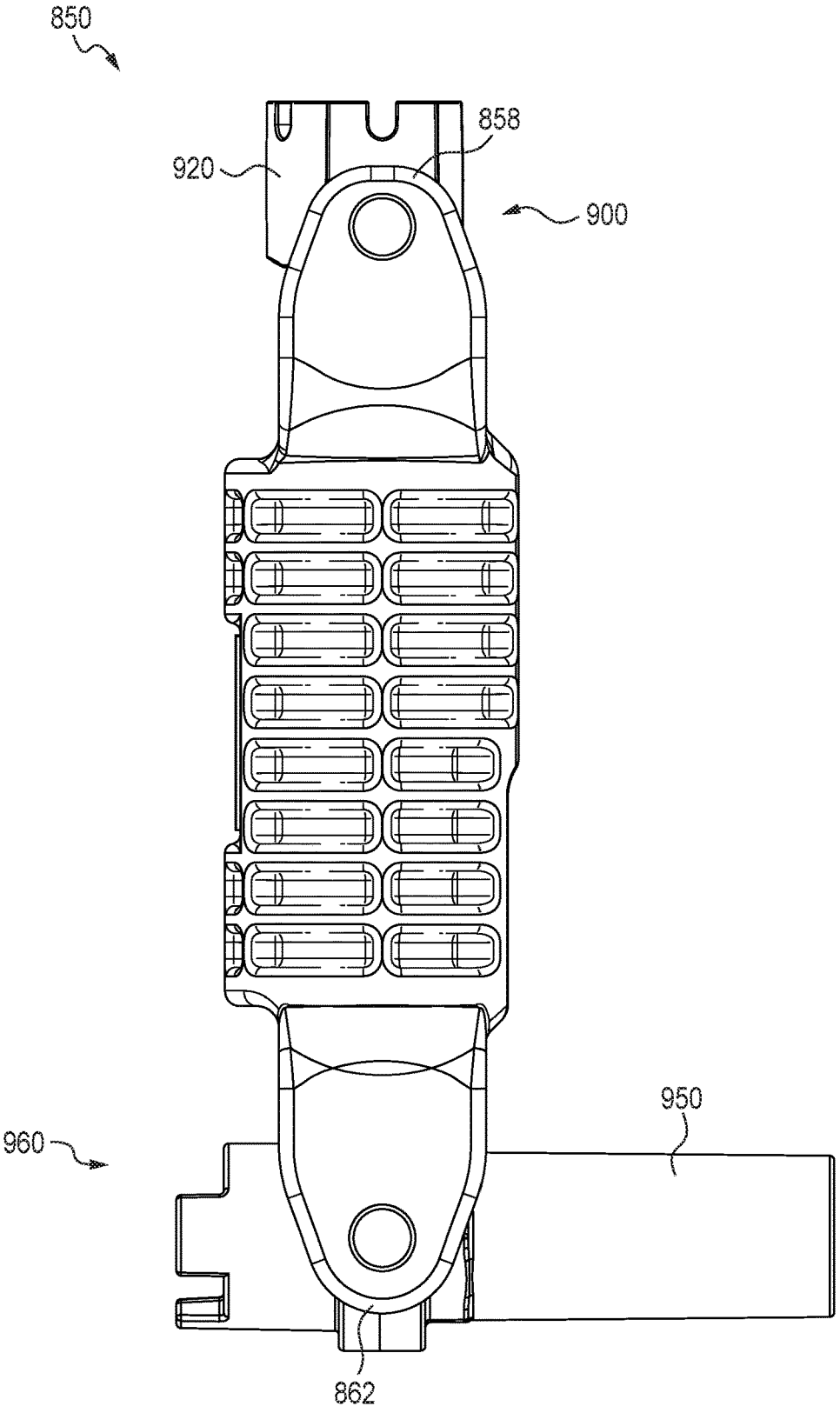
Figure 36:
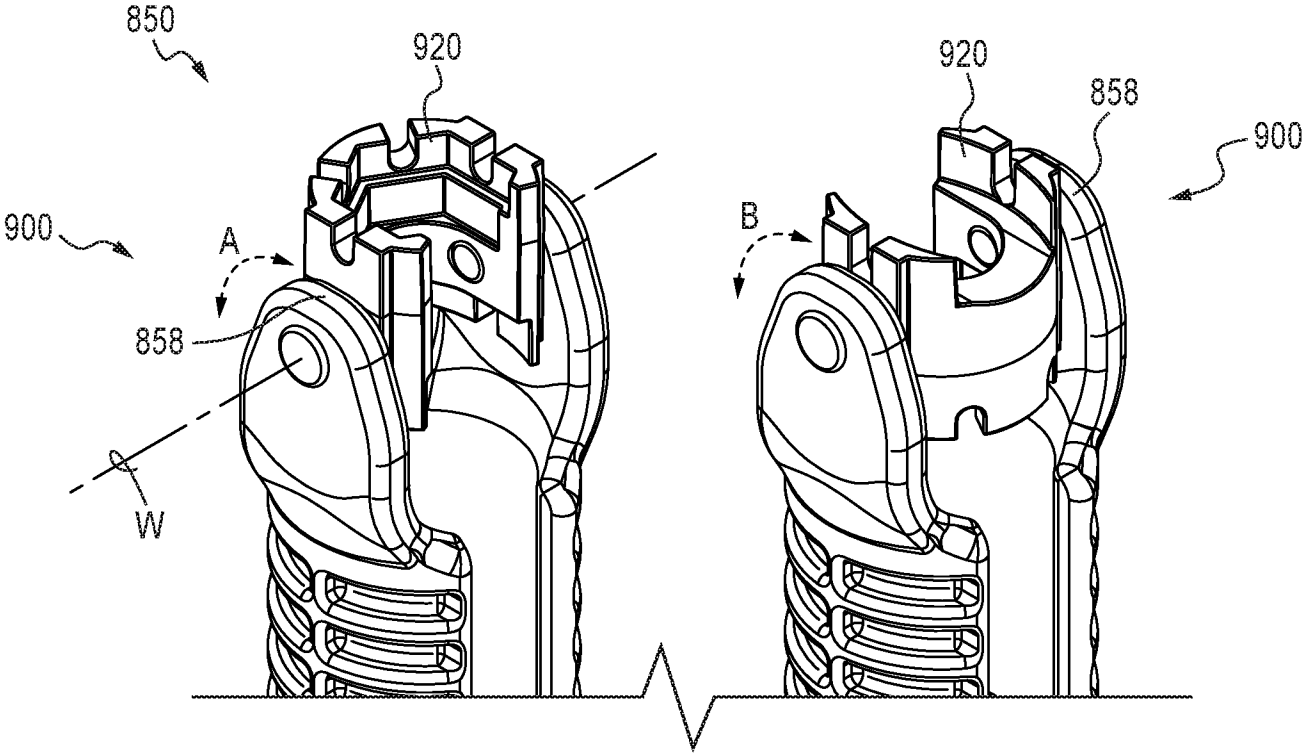
FIG. 36 is a detailed end view showing different pivotal positions of a first insert at an end of the handle of the tool system depicted in FIGS. 33-35.
Figure 37:
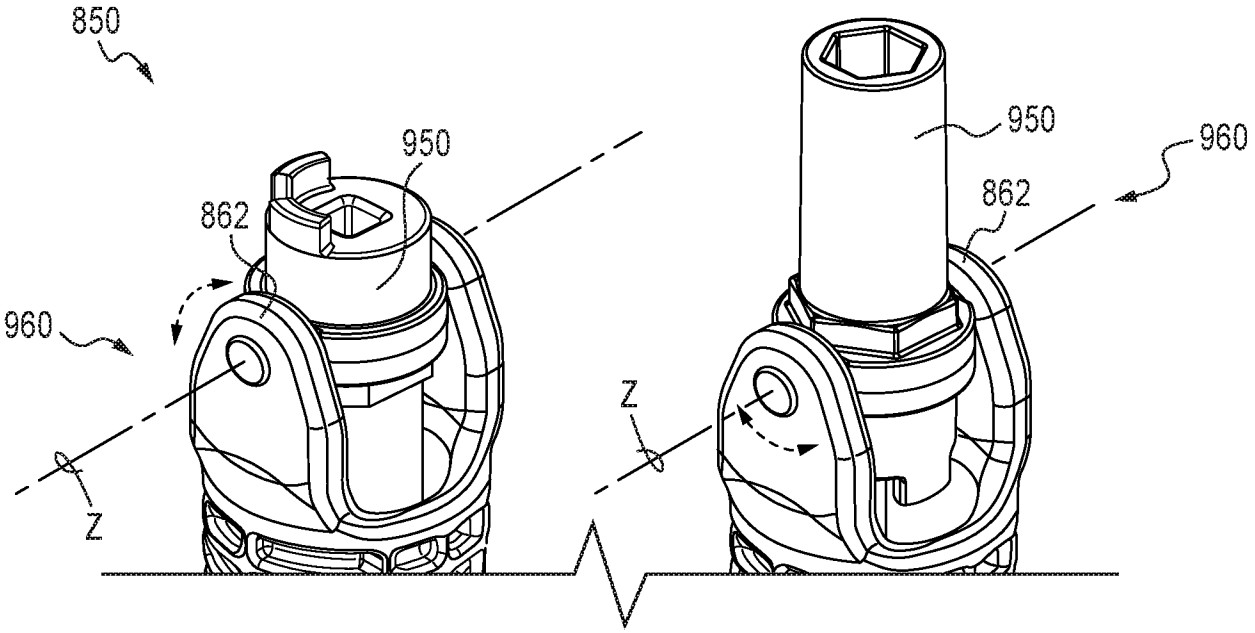
FIG. 37 is a detailed end view showing different pivotal positions of a second insert at another end of the handle of the tool system depicted in FIGS. 33-35.

In a particular version of the adapter 550, the inner periphery 554 is formed so as to provide a first hex profile 570 and a second hex profile 574. The two hex profiles 570 and 574 are separated by a step or ledge 572 extending partially around the inner periphery 554. As shown, the span of the first hex profile 570 is greater than the span of the second hex profile 574. Although the adapter 550 is shown as providing two hex profiles, it will be understood that the present subject matter includes adapters having profiles different than hex profiles, having a different number of profiles, and/or having a combination of differing profiles. However, it will be appreciated that by reference to FIG. 35, the insert 950 can be used to apply additional torque or leverage to the tool system and particularly the insert 920 without any additional or external drive mechanism such as an external wrench or bar. Since both inserts 920 and 950 are integrated with ends of the handle with a pivot, the potential for inadvertent removal or separation from the handle is avoided.

FIGS. 29-32 depict another version of an insert 750 for use in the present subject matter tool system such as any of the basin wrenches 50, 350. The insert 750 is similar to previously described inserts but includes two radially extending tabs 752 and two axially extending tabs 756. In this particular insert version, the radially extending tabs 752 are located on opposite sides of the insert, i.e., are 180° apart. And, the axially extending tabs 756 are located along one side or region of the insert and are located 90° apart from one another.

Instead of incorporating a pivot assembly within a handle or body of a wrench such as the wrench 350 shown in FIGS. 21-25, one or more pivot assemblies can be provided at an end or both ends of a wrench and configured such that the pivot assembly enables pivoting or selective orientation of the insert relative to the wrench and movably affixes the insert to the wrench. FIGS. 33-37 illustrate a basin wrench 850 having a first pivot assembly 900 generally located proximate a first end 858 of the wrench and a second pivot assembly 960 generally located proximate and a second end 862 of the wrench. The pivot assembly 900 includes a pivot pin 902 engaged with an insert 920 enabling the insert 920 to be pivoted about axis W as shown by arrow A in FIG. 36. The pivot assembly 960 includes a pivot pin 962 engaged with an insert 950 enabling the insert 950 to be pivoted about axis Z as shown by arrow B in FIG. 37. The remaining aspects of the basin wrench 850 are generally the same or similar as those of wrenches 50 and/or 350. However, it will be appreciated that by reference to FIG. 35, the insert 950 can be used to apply additional torque or leverage to the tool system and particularly the insert 920 without any additional or external drive mechanism such as an external wrench or bar. Since both inserts 920 and 950 are integrated with ends of the handle with a pivot, the potential for inadvertent removal or separation from the handle is avoided.

Figure 34:
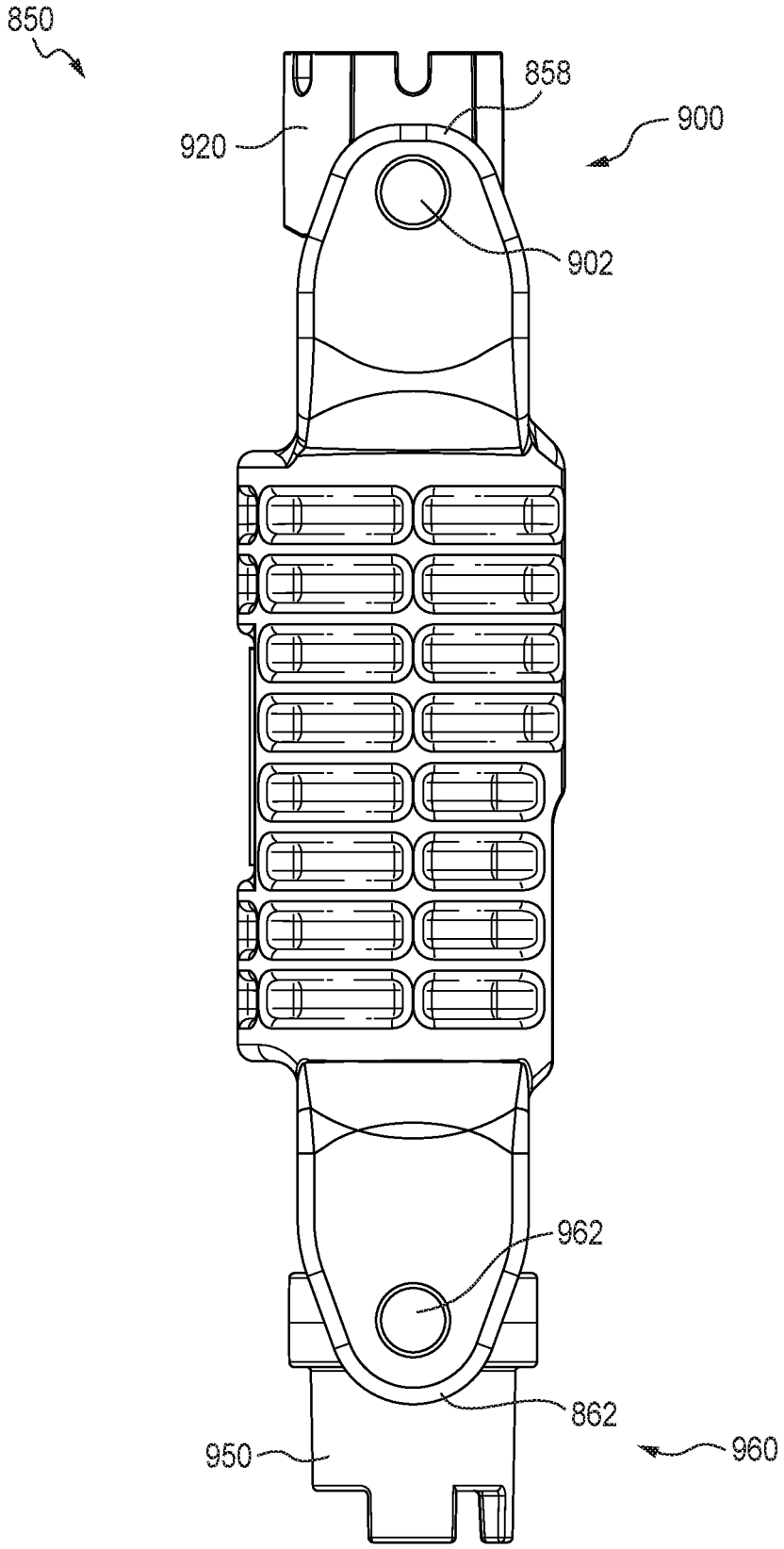
Figure 39:
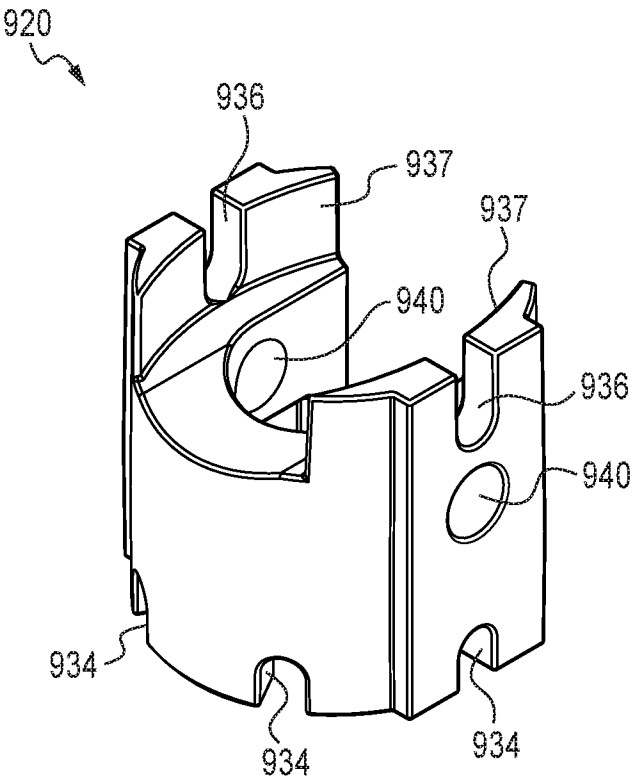
FIGS. 38-39 illustrate an insert that can be used in the present tool system depicted in FIGS. 33-35.
Figure 38:
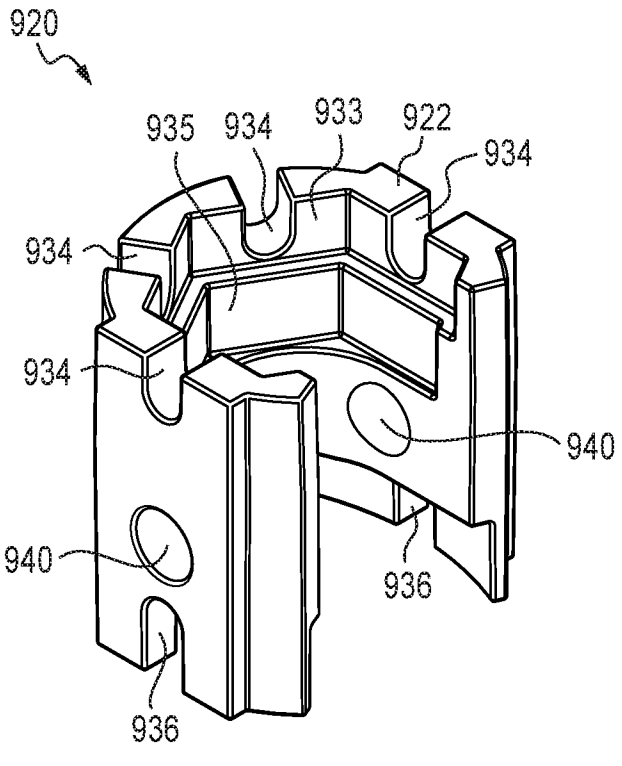

FIGS. 38-39 illustrate the insert 920 shown in use with the tool system 850 of FIGS. 33-37. The insert 920 defines a pair of aligned apertures 940 for receiving the pivot pin 902 such as shown in FIG. 34. The insert 920 also defines a plurality of engagement regions such as a first engagement region 933, a second engagement region 935, a third engagement region 934 in the form of a plurality of recesses along an end of the insert, and a fourth engagement region 936 in the form of a plurality of recesses along an opposite end of the insert. As will be appreciated, a user can selectively position the insert 920 to expose a desired engagement region by pivoting the insert about the pivot pin 902 extending through apertures 940. For example the insert 920 can be positioned to expose one or more hex profiles in the form of engagement regions 933, 935. Alternatively, the insert 920 can be positioned to expose the engagement region 936 in the form of recesses or slots. The insert 920 can also be provided with an engagement surface 937 configured to engage many shut-off valves. Thus, upon positioning the insert 920 to expose the surfaces 937, the tool can be used to engage many shut-off valves.

Figure 40:
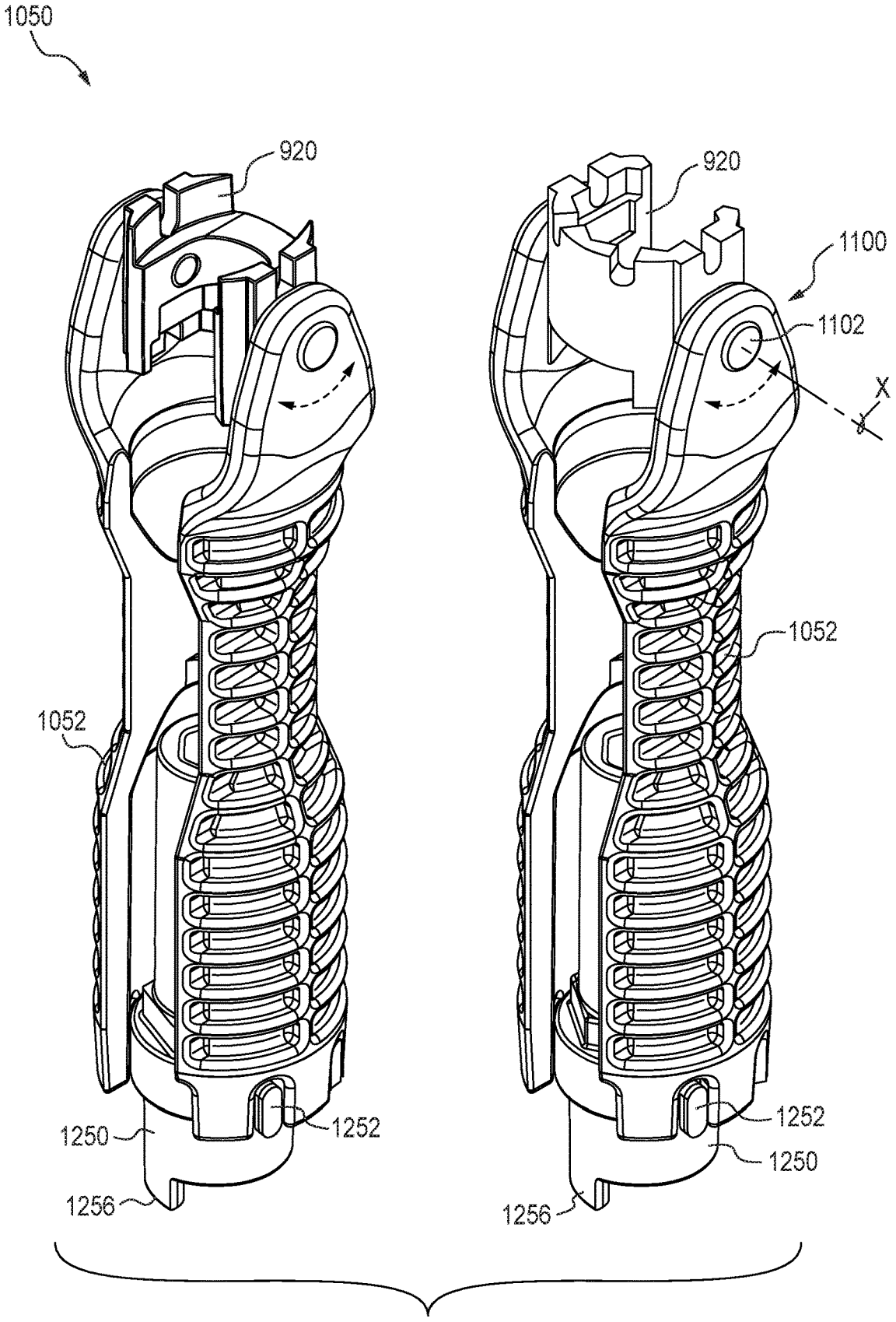
FIGS. 40-43 illustrate another embodiment of a tool system in accordance with the present subject matter.
Figure 41:
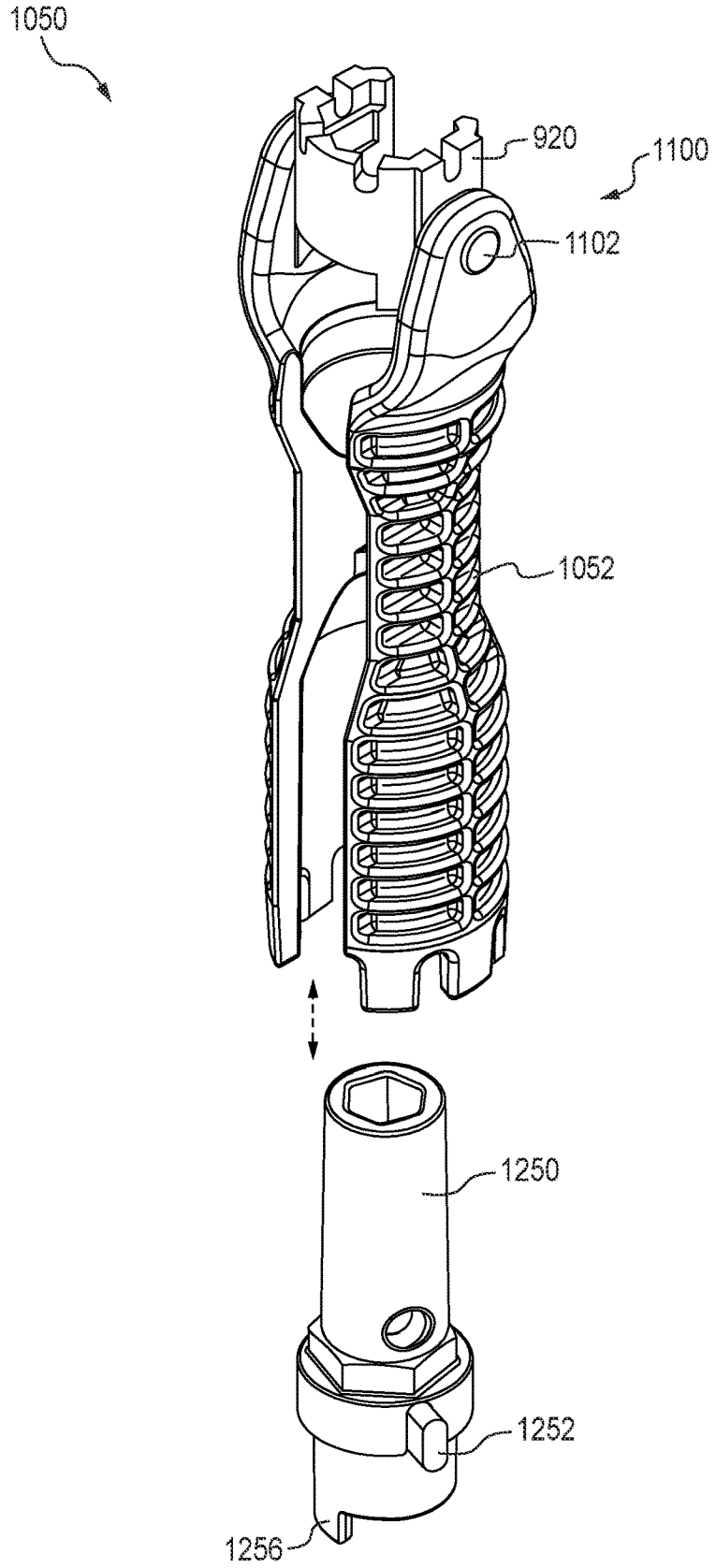
Figure 42:
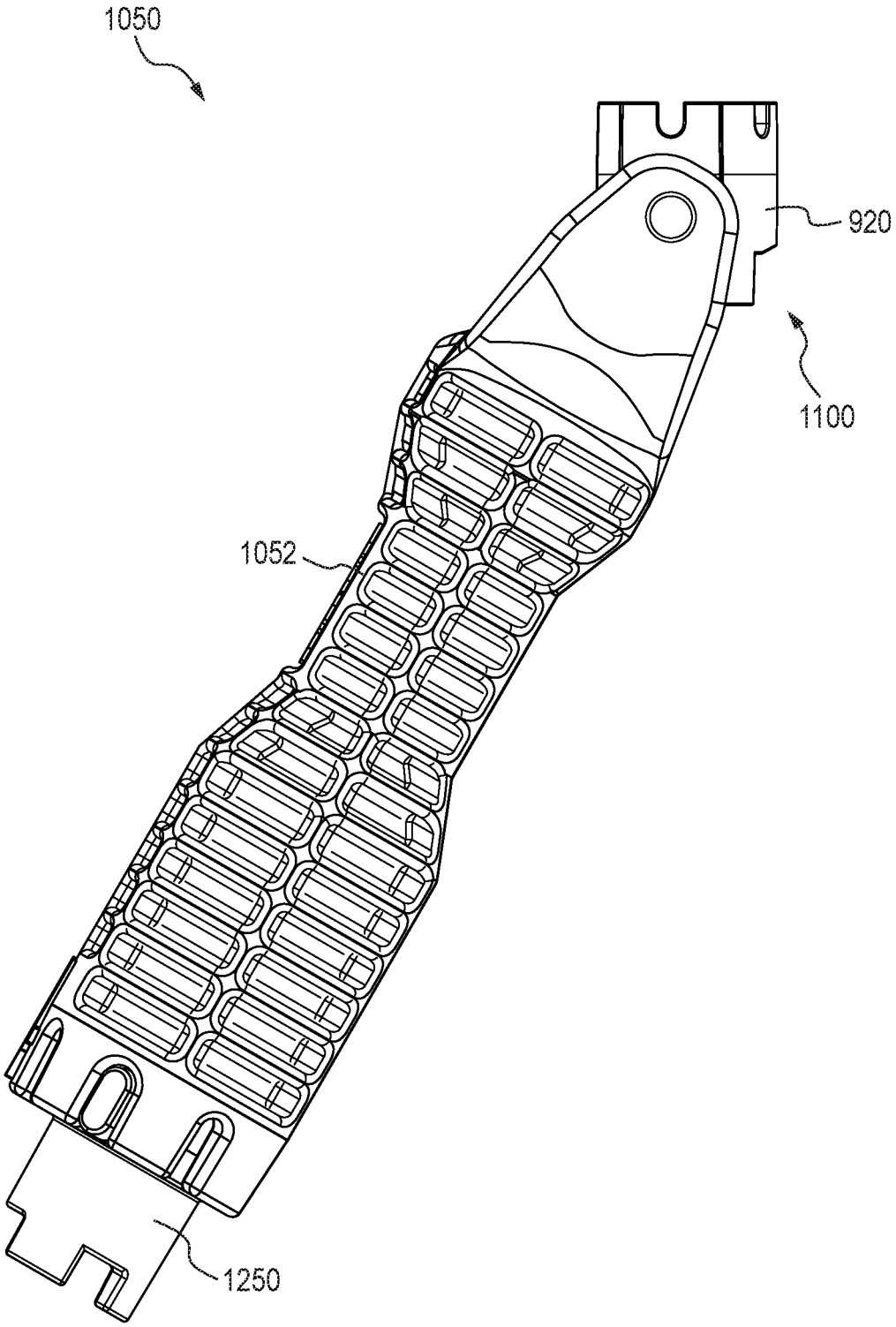
Figure 43:
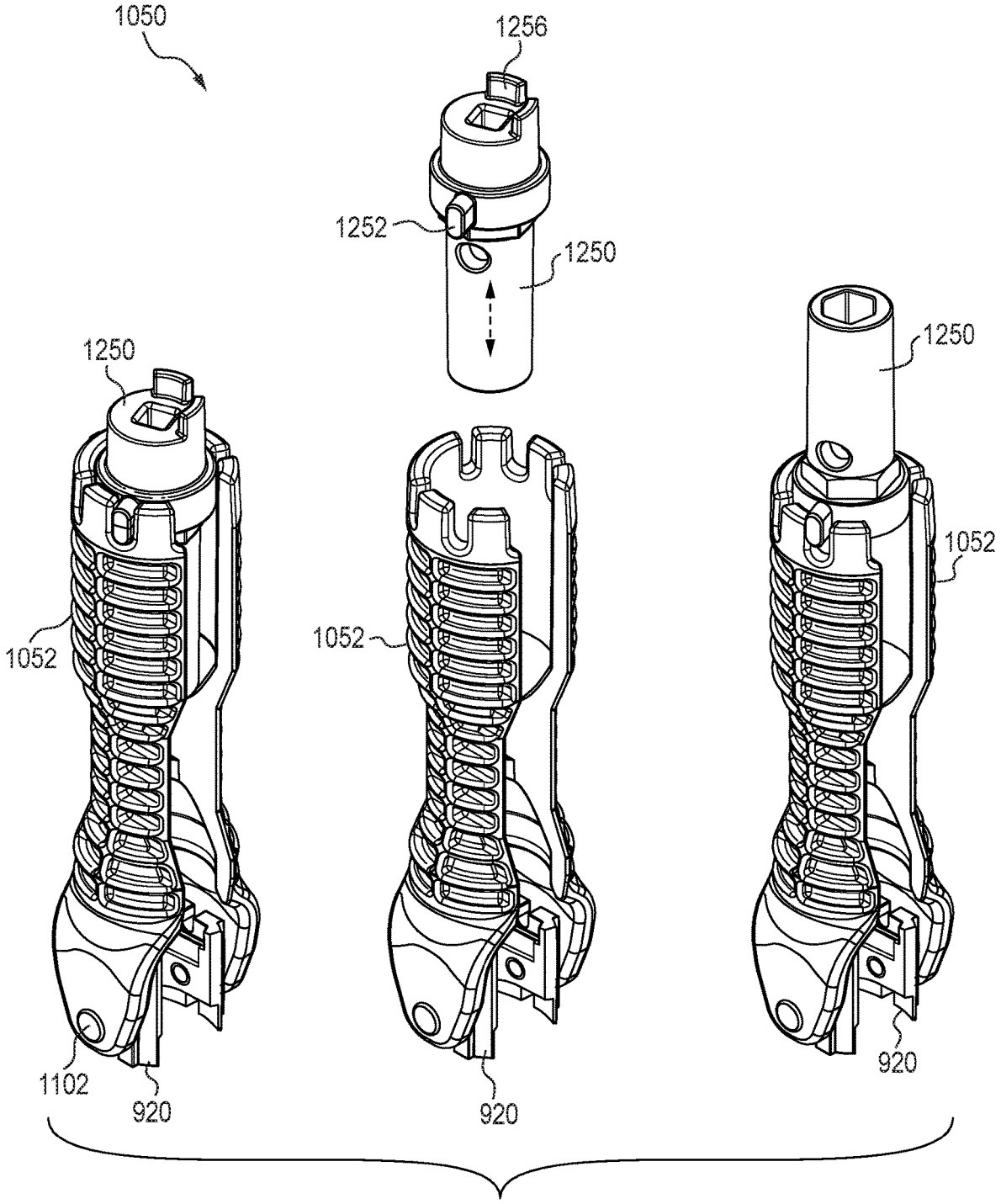

FIGS. 40-43 illustrate another embodiment of a basin wrench 1050 in accordance with the present subject matter. The basin wrench 1050 utilizes a single pivot assembly 1100 for movably affixing the previously described insert 920 to an end of the wrench body or handle 1052. The insert 920 is pivotally attached to the handle 1052 via a pivot pin 1102 thereby enabling the insert to be selectively positioned about axis X as shown in FIG. 40. The wrench 1050 has its other end configured for removably engaging another insert such as insert 1250. The insert 1250 is generally as previously described inserts 150, 250, 450, 750, and 950, but utilizes a single axially extending tab 1256 in combination with a single radially extending tab 1252. As will be understood, the tab 1252 is configured to be engaged in notches or slots defined along an end or other region of the handle 1052 so that upon engagement between the insert 1250 and handle 1052 as shown in FIG. 43, the insert 1250 can be rotated about its longitudinal axis by rotating the handle 1052 about its longitudinal axis.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. In combination with a basin wrench (50), a cube-shaped insert (120), wherein the basin wrench (50) comprises an elongated generally hollow body (52) defining a longitudinal axis (54), the generally hollow body (52) including an open end portion (58) defining a square section (90) spaced from the longitudinal axis (54), wherein the square section (90) defines a spaced-apart pair of elongated slots (64) through two opposite sides of the square section (90), each slot (64) being generally aligned with the longitudinal axis (54), wherein the cube-shaped insert (120) defines six working faces (122, 124, 126, 128, 130, 132), wherein a first adjacent pair (126, 132) of the six working faces (122, 124, 126, 128, 130, 132) together define a first recess (134), wherein a second adjacent pair (130, 132) of the six working faces (122, 124, 126, 128, 130, 132) together define a second recess (134), wherein a plurality (126, 128, 130, 132) of the six working faces (122, 124, 126, 128, 130, 132) each defines an engagement region (127, 129, 131, 133), and wherein at least one (132) of the plurality of working faces includes a plurality of engagement regions (133, 135), and wherein the open end portion (58) of the generally hollow body (52) is configured to fittingly receive the cube-shaped insert (120), and wherein the slots (64) through the sidewall section (90) are located, relative to the first and second recesses (134) of the cube-shaped insert (120), such that one of the first and second recesses (134) aligns with one of the pair of slots (64) and the other of the first and second recesses (134) aligns with the other of the pair of slots (64) when the cube-shaped insert (120) is fittingly received in the open end portion (58) of the generally hollow body (52).

2. In combination with a cube-shaped insert (120), a basin wrench (50) configured for operative engagement with a faucet assembly, wherein the basin wrench (50) comprises an elongated generally hollow body (52) defining a longitudinal axis (54), wherein the generally hollow body (52) includes an open end portion (58) defining a square section (90) spaced from the longitudinal axis (54), wherein the square section (90) defines a spaced-apart pair of elongated slots (64) through two opposite sides of the square section (90), and wherein each slot (64) is generally aligned with the longitudinal axis (54), and wherein the cube-shaped insert (120) defines six working faces (122, 124, 126, 128, 130, 132), wherein a first adjacent pair (126, 132) of the six working faces (122, 124, 126, 128, 130, 132) together define a first recess (134), and wherein a second adjacent pair (130, 132) of the six working faces (122, 124, 126, 128, 130, 132) together define a second recess (134), and wherein a plurality (126, 128, 130, 132) of the six working faces (122, 124, 126, 128, 130, 132) each defines an engagement region (127, 129, 131, 133), and wherein at least one (132) of the plurality of working faces includes a plurality of engagement regions (133, 135), and wherein the open end portion (58) of the generally hollow body (52) is configured to fittingly receive the cube-shaped insert (120), wherein the slots (64) through the sidewall section (90) are located, relative to the first and second recesses (134) of the cube-shaped insert (120), such that one of the first and second recesses (134) aligns with one of the pair of slots (64) and the other of the first and second recesses (134) aligns with the other of the pair of slots (64) when the cube-shaped insert (120) is fittingly received in the open end portion (58) of the generally hollow body (52), and wherein the first and second recesses (134), each of the pair of slots (64) and the plurality of engagement regions (133, 135) are configured and dimensioned to operatively engage a corresponding component of the faucet assembly.

* * * * *